US010227774B2

(12) United States Patent
Ryan et al.

(10) Patent No.: US 10,227,774 B2
(45) **Date of Patent: *Mar. 12, 2019**

(54) COLUMN PROTECTOR AND COLUMN PROTECTION SYSTEM

(71) Applicant: Sentry Protection LLC, Lakewood, OH (US)

(72) Inventors: James P. Ryan, Lakewood, OH (US); Jeffrey P. Wagner, Greenfield, IN (US)

(73) Assignee: Sentry Protection LLC, Lakewood ( * ) Notice: Subject to any disclaimer, the term of this patent is extended or adjusted under 35 U.S.C. 154(b) by 0 days.

This patent is subject to a terminal disclaimer.

(21) Appl. No.: 15/547,575

(22) PCT Filed: Feb. 1, 2016

(86) PCT No.: PCT/US2016/015985

§ 371 (c)(1),
(2) Date: Jul. 31, 2017

(87) PCT Pub. No.: WO2016/123623

PCT Pub. Date: Aug. 4, 2016

(65) Prior Publication Data

US 2018/0002920 A1 Jan. 4, 2018

Related U.S. Application Data

(60) Provisional application No. 62/110,520, filed on Jan. 31, 2015.

(51) Int. Cl.
*E01F 15/14* (2006.01)
*E04B 1/92* (2006.01)
(Continued)

(52) U.S. Cl.
CPC ..... *E04B 1/92* (2013.01); *E01F 15/141* (2013.01); *E04C 3/30* (2013.01); *E04C 3/36* (2013.01); *E04G 23/00* (2013.01); *E04C 3/29* (2013.01)

(58) Field of Classification Search
CPC . E01F 15/141; E04B 1/92; E04C 3/30; E04G 23/00
(Continued)

(56) References Cited

U.S. PATENT DOCUMENTS 3,590,547 A * 7/1971 Molyneux ..... E04B 1/944 52/478
5,006,386 A 4/1991 Menichini
(Continued)

FOREIGN PATENT DOCUMENTS

WO 2007087437 A2 8/2007

OTHER PUBLICATIONS

International Search Report and Written Opinion dated Apr. 13, 2016 for PCT/US2016/015985 filed Feb. 1, 2016.

*Primary Examiner* — Charles A Fox
*Assistant Examiner* — James J Buckle, Jr.
(74) *Attorney, Agent, or Firm* — Wegman, Hessler & Vanderburg

(57) ABSTRACT

An apparatus for protection of an elongated structural support from impact, the apparatus includes an elongated impact protection component in the form of a unitary part having an inner surface, an outer surface, and a plurality of orthogonally-oriented projections spaced along a length of the elongated impact protection component. The projections of the elongated impact protection component include integrally formed connectors for interlocking connection to other same type impact protection components.

8 Claims, 23 Drawing Sheets

(51) Int. Cl.

| | |
|---|---|
| ***E04C 3/30*** | (2006.01) |
| ***E04G 23/00*** | (2006.01) |
| ***E04C 3/36*** | (2006.01) |
| *E04C 3/29* | (2006.01) |

(58) Field of Classification Search
USPC ..... 52/514
See application file for complete search history.

(56) References Cited

U.S. PATENT DOCUMENTS

| | | | | |
|---|---|---|---|---|
| 5,605,414 | A * | 2/1997 | Fuller | E01F 15/0469 116/63 R |
| D380,274 | S * | 6/1997 | Stamets | D25/38.1 |
| 5,956,920 | A | 9/1999 | Davis | |
| 6,102,611 | A * | 8/2000 | Roller | E01F 15/141 267/116 |
| 6,242,070 | B1 * | 6/2001 | Gillispie | E01F 15/141 428/122 |
| 9,169,639 | B1 * | 10/2015 | Conroy | E04B 1/92 |
| 9,732,485 | B2 | 8/2017 | McCue et al. | |
| 2001/0022056 | A1 | 9/2001 | Gifford | |
| 2006/0010823 | A1 | 1/2006 | Waters et al. | |
| 2012/0324826 | A1 | 12/2012 | Petta | |

* cited by examiner

COLUMN PROTECTOR AND COLUMN PROTECTION SYSTEM

CROSS-REFERENCE TO RELATED APPLICATIONS

This application is a national phase of International PCT Application PCT/US2016/015985 filed Feb. 1, 2016 and published under PCT 21(2) in the English language, which is incorporated herein by reference in its entirety, and which claims the priority filing benefit of U.S. Provisional Patent Application Ser. No. 62/110,520, filed Jan. 31, 2015, which is incorporated herein by reference in its entirety.

FIELD OF THE INVENTION

The disclosed column protector and column protection system are directed to a column protector and column protection system having interconnecting features suitable for safeguarding columns, posts, beams and structural supports in a warehouse or similar environment which helps reduce costs associated with building repairs due to accidental collisions.

BACKGROUND OF THE INVENTION

A column, like any other structure, depends on its form for its structural integrity. Once the form has been compromised, the load carrying capacity of the member is reduced. Generally, once a column has been deformed, particularly in the area of the corner radii, it will no longer carry its rated load. A damaged column may still support some indefinable load, but will not support the maximum design load.

Structural support damage can occur incrementally over time, rather than catastrophically. While it may be easy to recognize damage resulting from a major impact with a column, it is more difficult to identify supports that have sustained repeated minor impacts over a period of time, and appear merely dented, but whose load carrying capacity has been reduced. Damaged columns may have insufficient strength to be reasonably safe. It is better to prevent such damage, rather than identifying and repairing it after the fact.

Damage to columns, in a warehouse setting for example, due to accidental contact or collisions occurs frequently. Damage to equipment, such as fork lifts or tow motors, and injuries to equipment operators are also major concerns. Previous attempts to protect columns, equipment and operators from harm due to collisions generally involve molded plastic pieces intended to fit only with a particular column size and configuration. Conventional column protectors are somewhat effective when used on a column of the intended dimensions but are either unusable, or have greatly diminished protective properties, when used on columns of a different size.

Flexible sheets have also been used to wrap a column, but are thin so as to remain flexible and do not offer the same level of impact absorption and protection as thicker, more robust materials. Therefore, neither conventional molded protectors, nor the flexible sheet, provide a particularly effective, cost-efficient and convenient solution for protecting columns of various sizes.

BRIEF SUMMARY OF THE INVENTION

In one aspect, an apparatus for protection of an elongated structural support from impact includes an elongated impact protection component in the form of a unitary part having an inner surface, an outer surface, and a plurality of orthogonally-oriented projections spaced along a length of the elongated impact protection component, wherein the projections include integrally formed connectors for interlocking connection to other same type impact protection components. The orthogonally-oriented projections are configured for sliding engagement with projections from an adjacent elongated impact protection component, and the inward and/or outward motion of each interlocked protection component is constrained by the adjacent protection component.

In another aspect, the elongated impact protection component includes a first set of projections extending in a first direction, wherein the projections in the first set of projections include channels having a cross-sectional shape, and a second set of projections extending in a second direction orthogonal to the first direction. The projections in the second set of projections include ribs having a complementary cross-sectional shape to the cross-sectional shape of the channels. The interlocking connection of the elongated protection component to other same type impact protection components prevents separation of the elongated protection components.

In some aspects, the elongated protection component can include a hollow, unitary molded component whose inner surface of the elongated impact protection component is geometrically similar to a portion of the column. The elongated impact protection component can include opposing end portions having indentations for accepting a securing mechanism. The projections are sized for a friction fit with projections from other same type impact protection components.

In other aspects, a column protection system, includes a plurality of protection components that fit adjacent to each other in installed positions on a column. Each of the protection components includes a body having a length extending between opposing end portions, wherein the body includes a first side portion, a second side portion, an inner portion that receives a portion of the column, and an outer portion, and a plurality of projections extending from the first side portion and the second side portion along the length of the body, wherein the projections of the first side portion of each protection component engage the projections of the second side portion of each adjacent protection component, and the projections of the first side portion of each protection component abut the second side portion of the adjacent protection component when the column has a cross-section x, and the projections of the first side portion of the each protection component engage the second side portion of the adjacent component, defining spaces therebetween, when the column has a cross-section greater than x.

In other aspects, the plurality of projections extending from the first side portion of each protection component are orthogonally-oriented to the projections extending from the second side portion of the same protection component.

In further aspects, the projections of the first side portion and the projections of the second side portion of each of the protection components are generally parallel, and the spaces defined therebetween are substantially the same width as the projections.

In some aspects, the projections of the first and second side portions of each of the protection components include integrally formed connectors that interlock when engaged and prevent separation of the protection components.

In other aspects, the plurality of projections extending from the first side portion of each of the protection components include channels having a cross-sectional shape, and the projections extending from the second side portion of each of the protection components include ribs having a complementary cross-sectional shape to the cross-sectional shape of the channels.

In some aspects, the column protection system includes two or more protection components installed on a column, and the projections of the first edge portion of each protection component interlock with the projections of the second edge portion of each adjacent protection component.

In further aspects, an inward and outward motion of each interlocked protection component is constrained by the adjacent protection component. The interlocked projections include substantially planar side walls that converge, and the interlocked projections include a friction fit, and the friction fit secures each protection component to an adjacent protection component.

Advantages of the disclosed column protector and adaptable protection system will become more apparent to those skilled in the art from the following description of the embodiments which have been shown and described by way of illustration. As will be realized, the column protector and adaptable protection system are capable of other and different embodiments, and their details are capable of modification in various respects.

BRIEF DESCRIPTION OF THE DRAWINGS

These and other features of the disclosed column protector and adaptable protection system, and their advantages, are illustrated specifically in embodiments of the column protector and adaptable protection system now to be described, by way of example, with reference to the accompanying diagrammatic drawings, in which.

Figure 6:
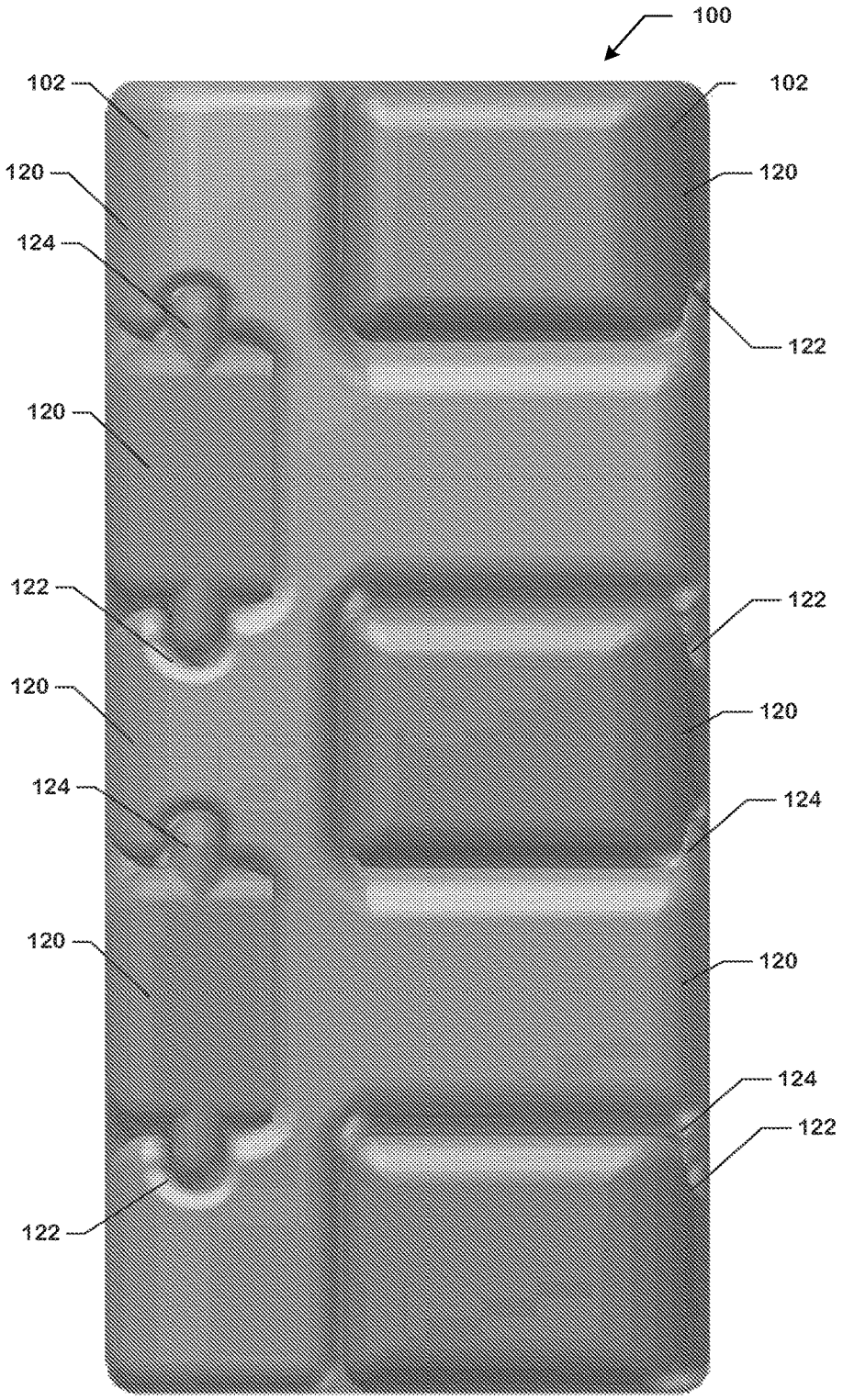
Figure 7:
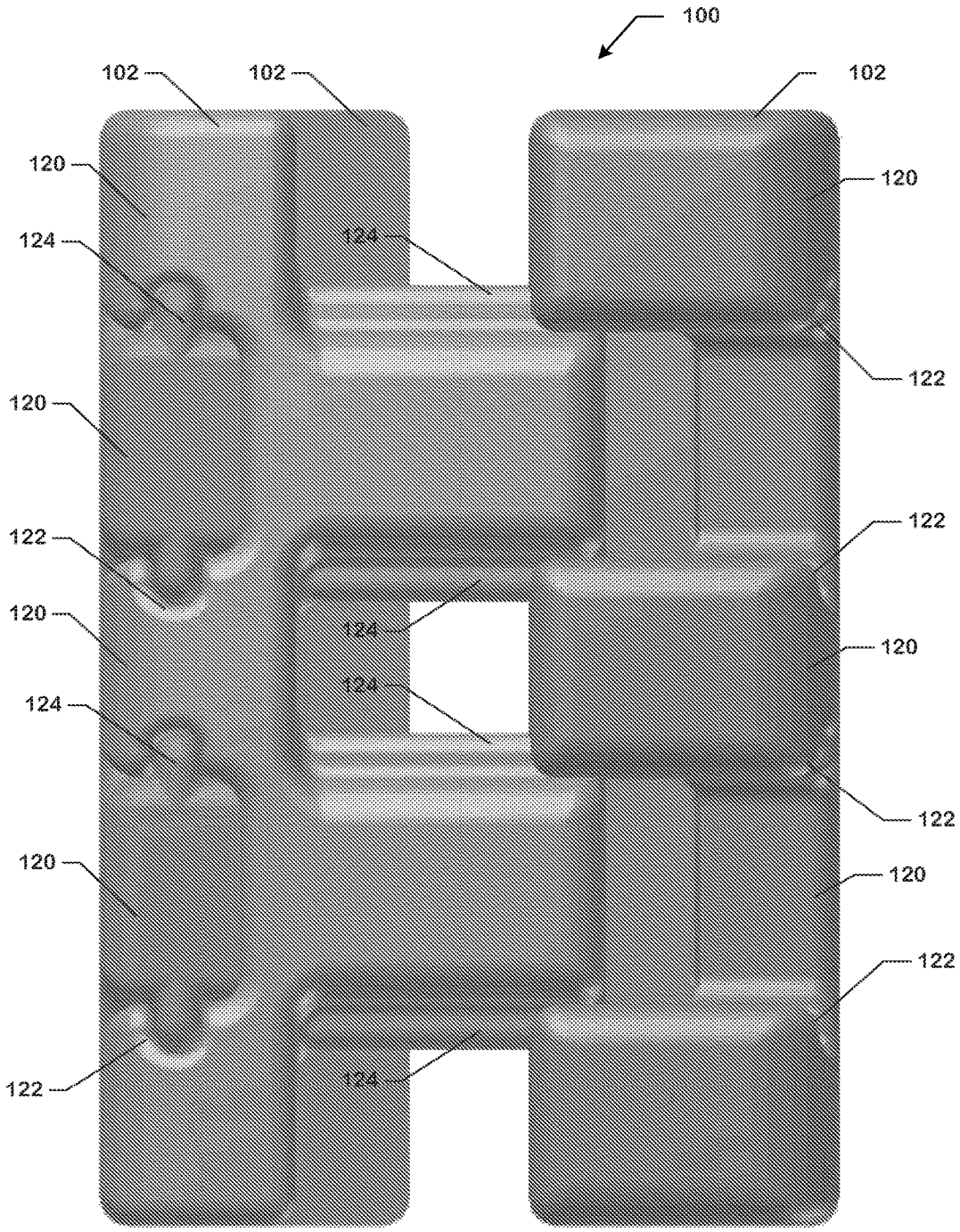
Figure 8:
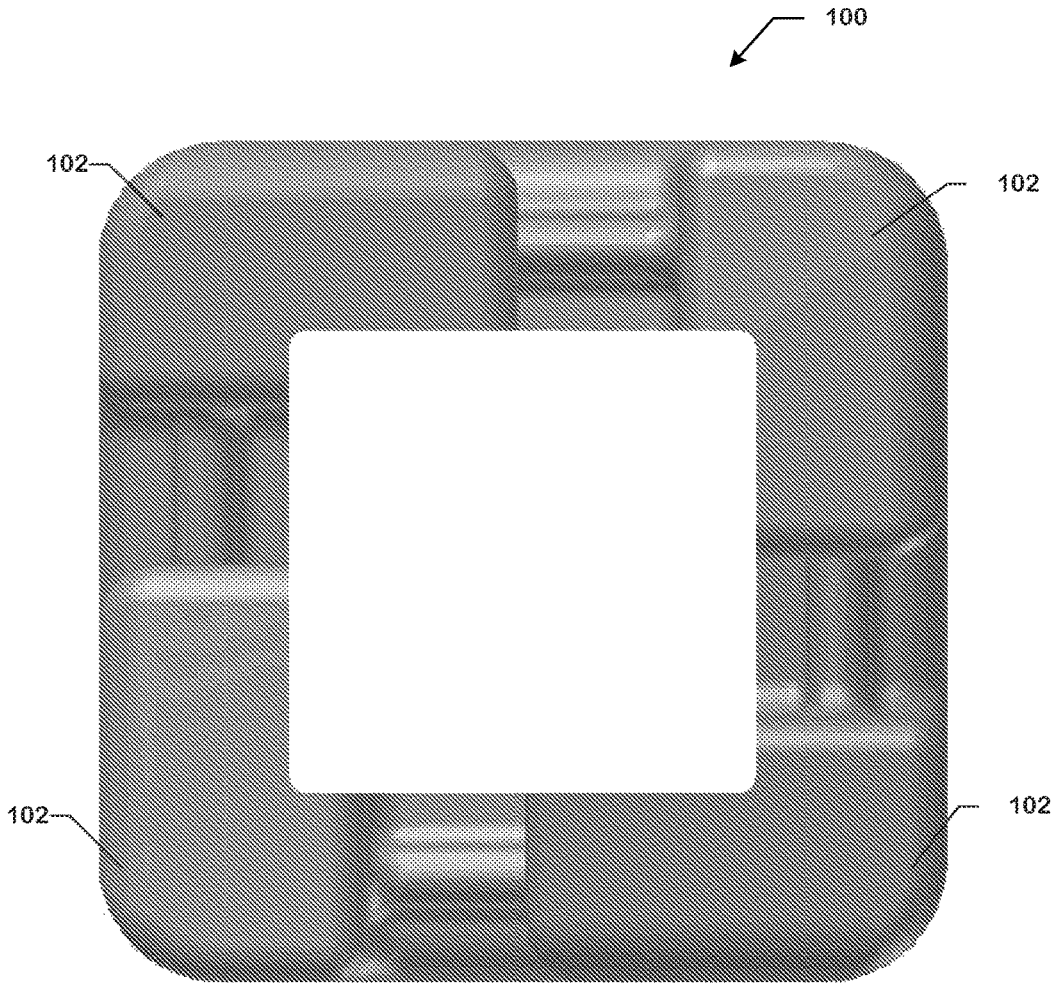
Figure 9:
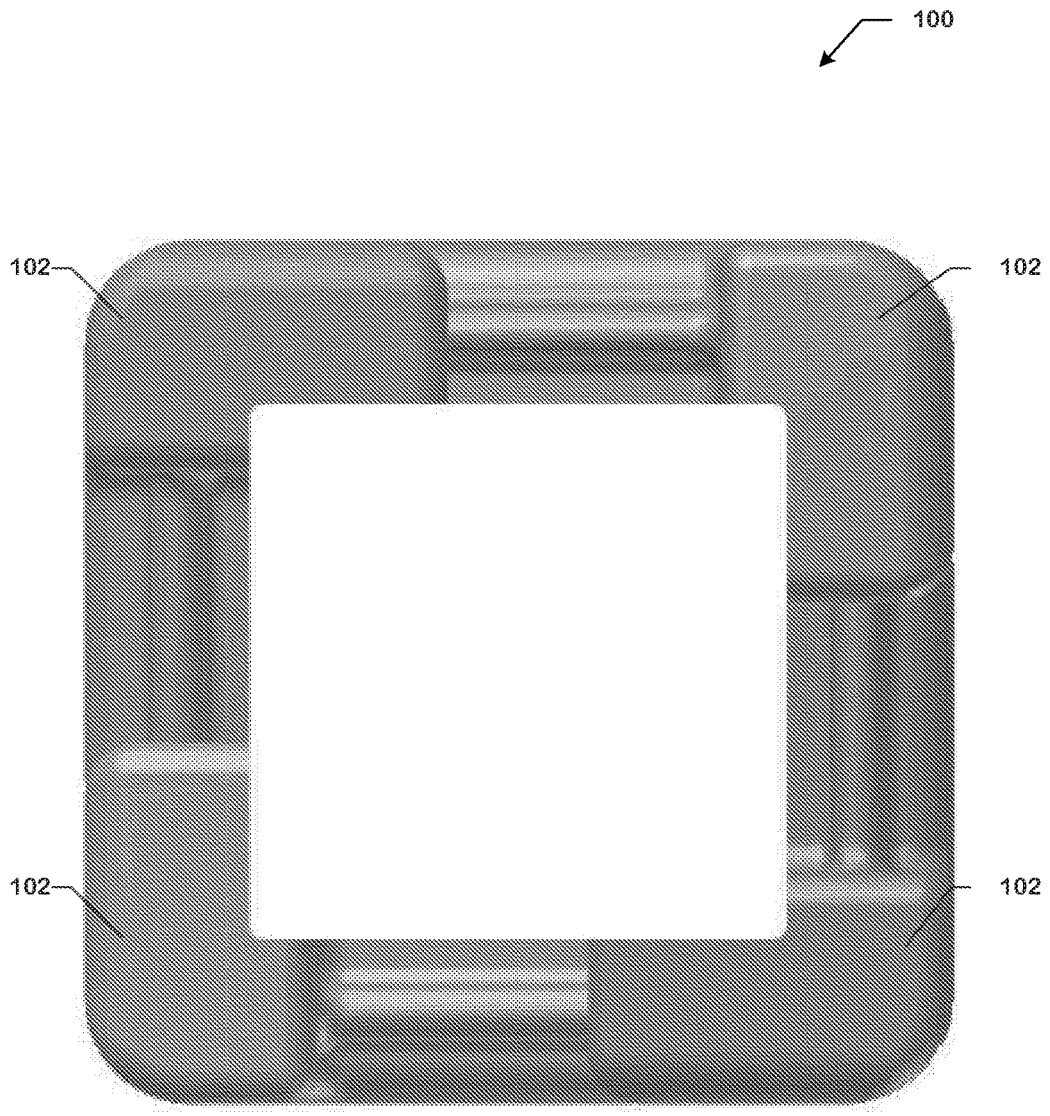
Figure 10:
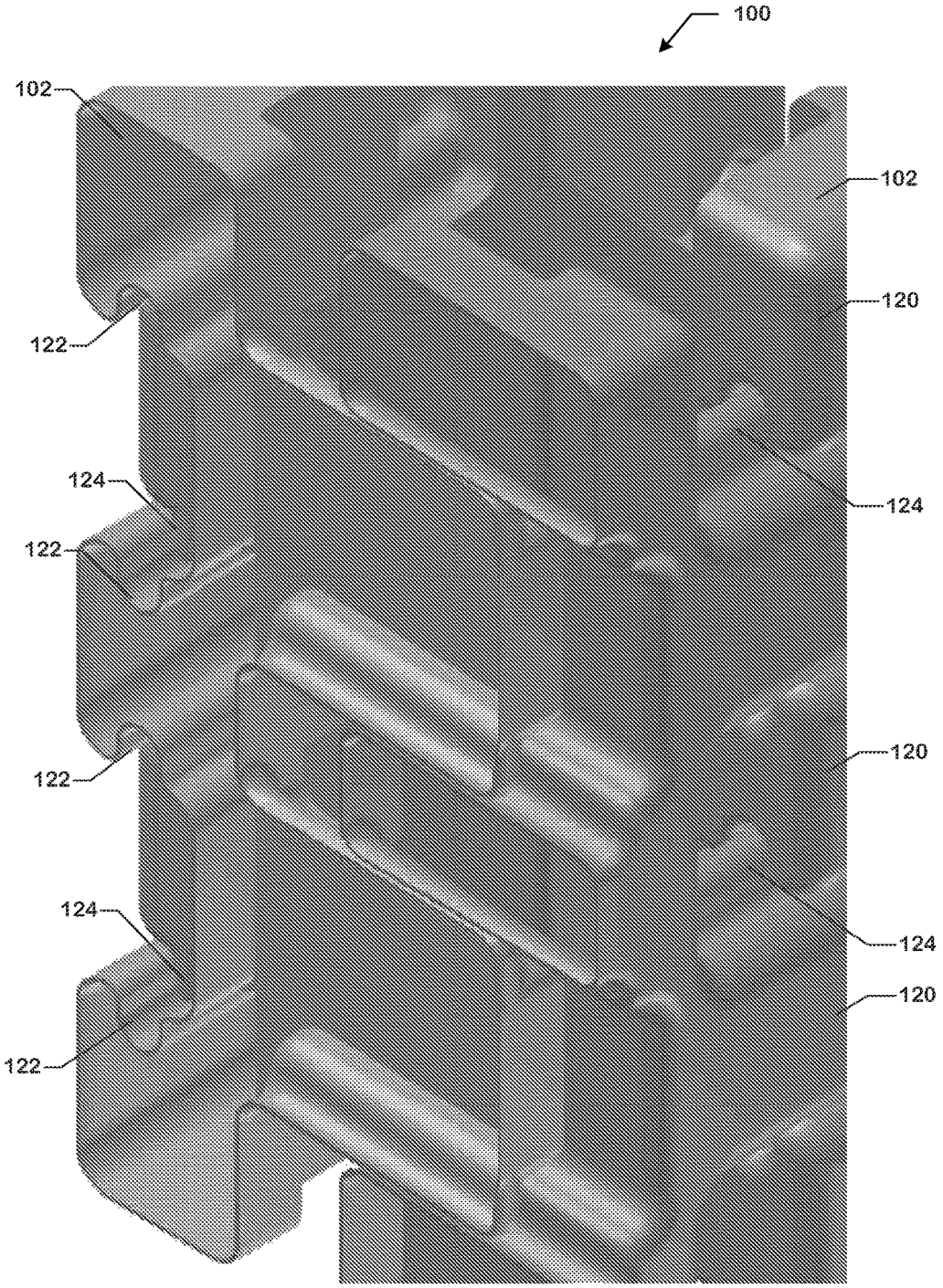
Figure 11:
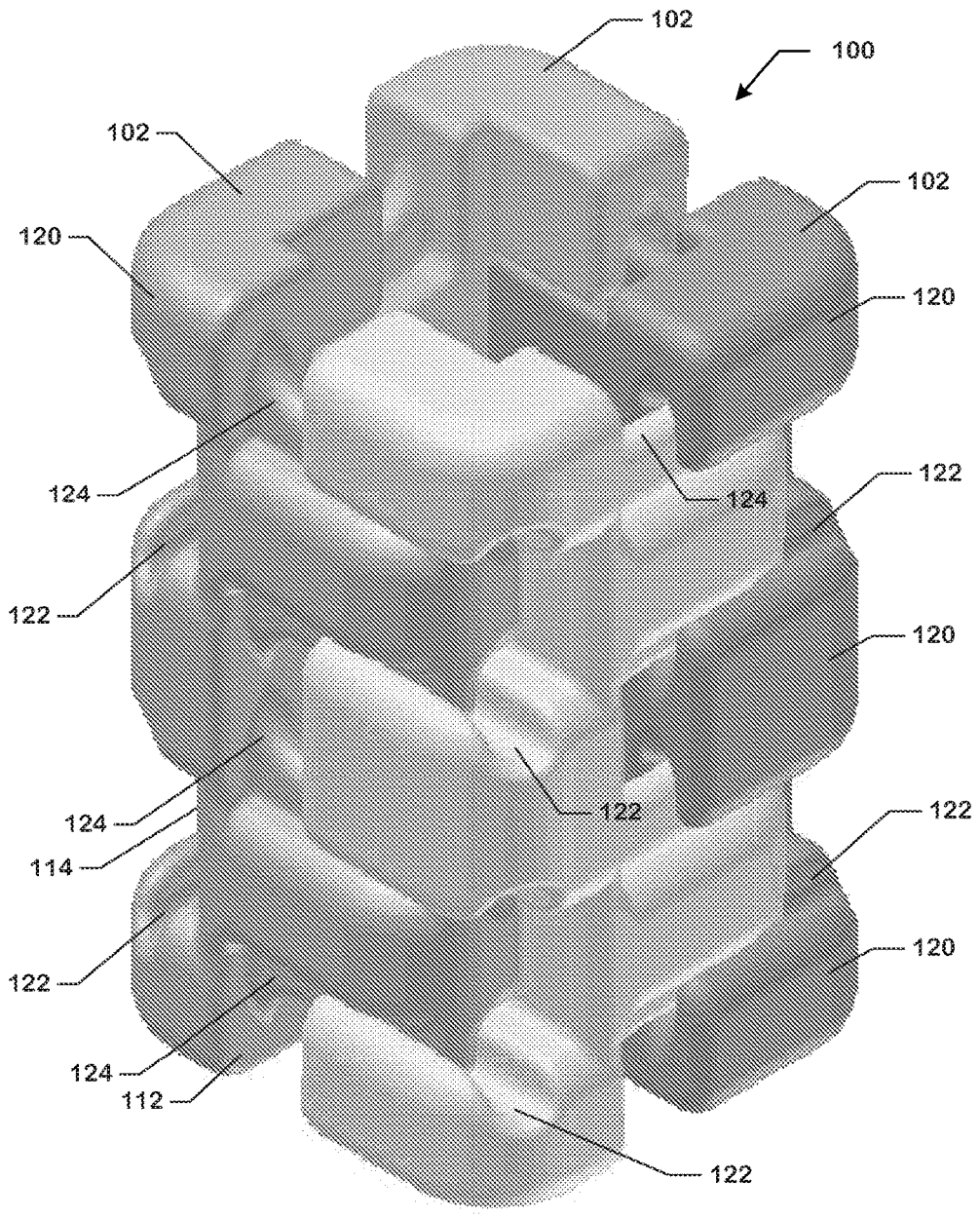
Figure 12:
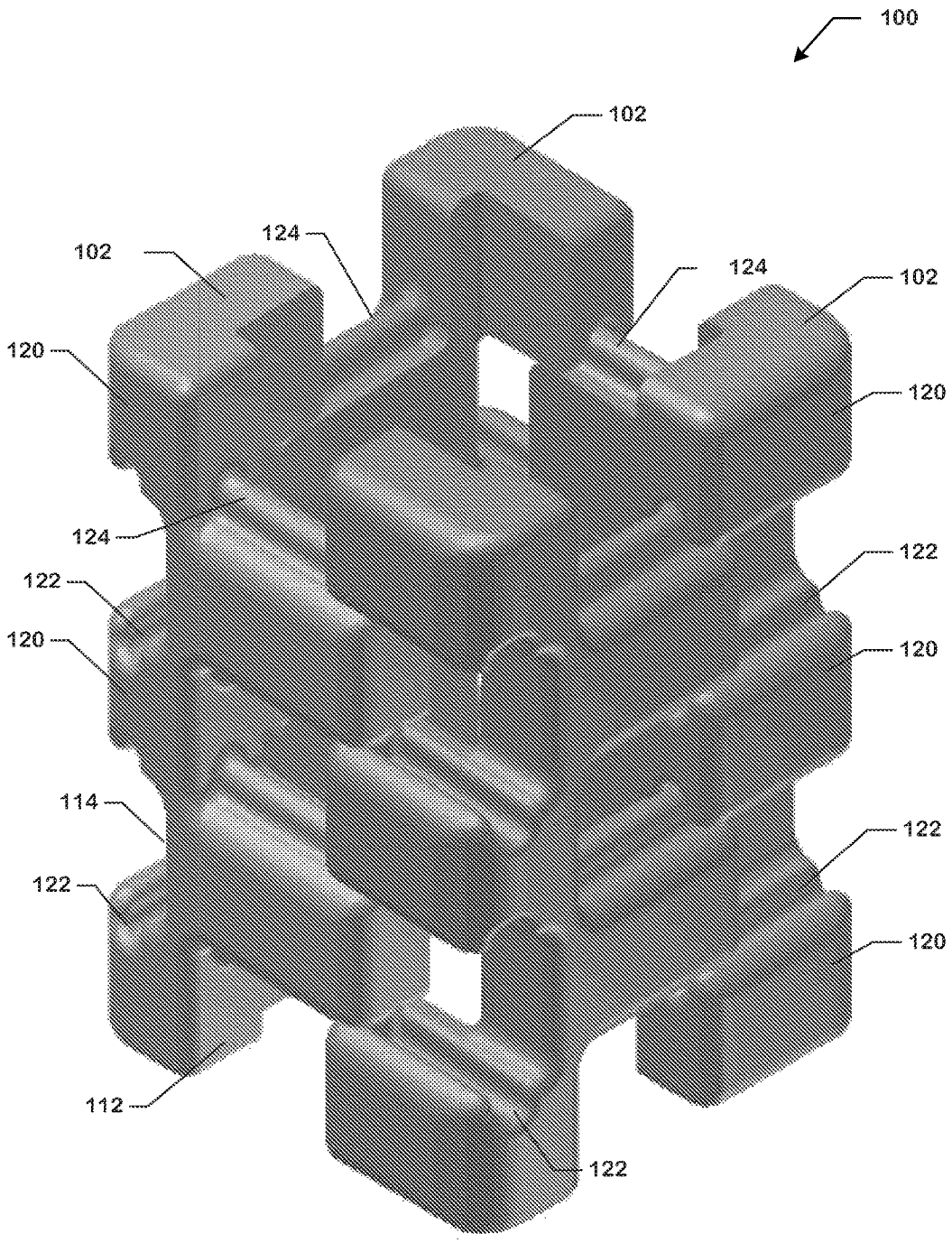
Figure 13:
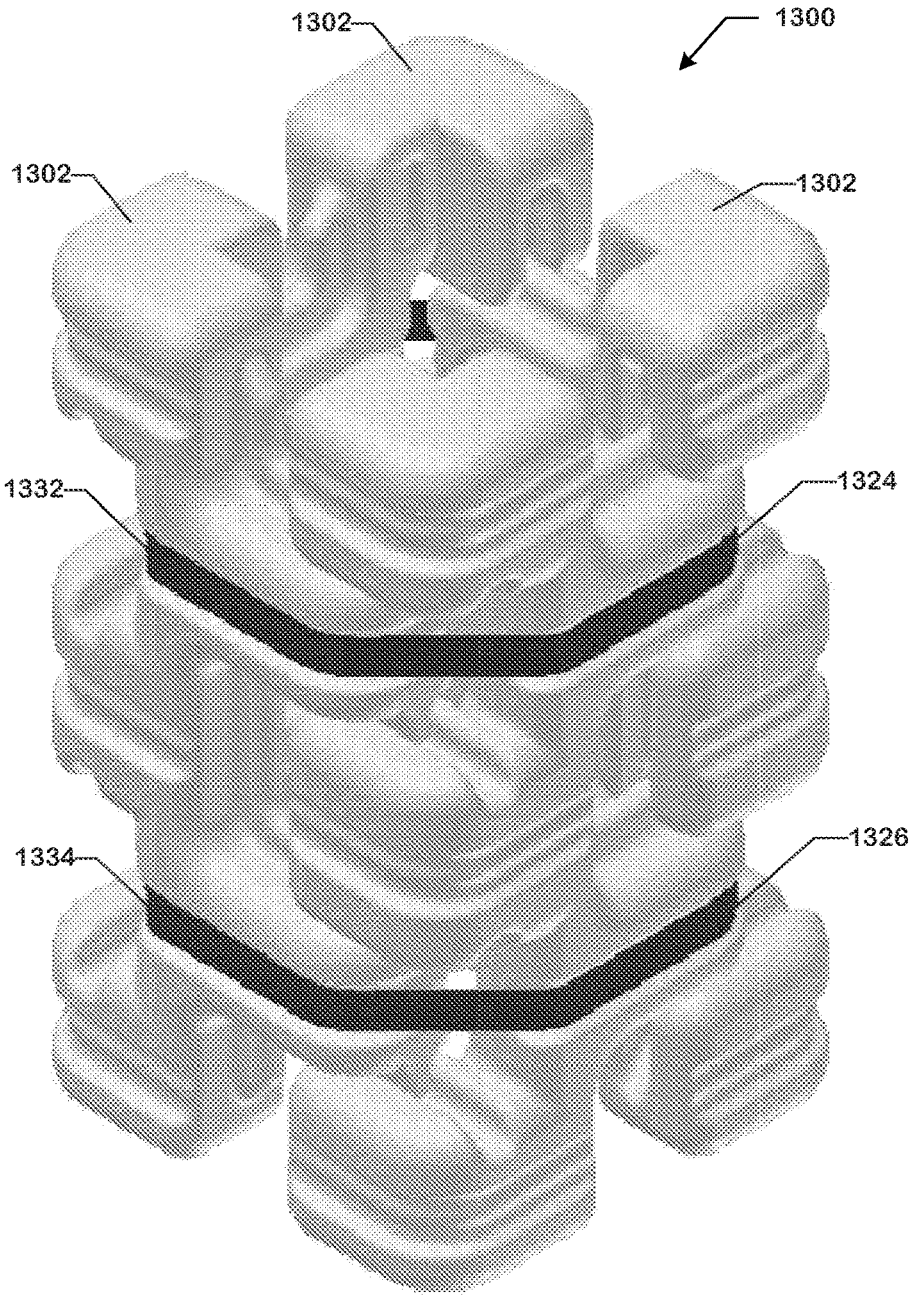
Figure 14:
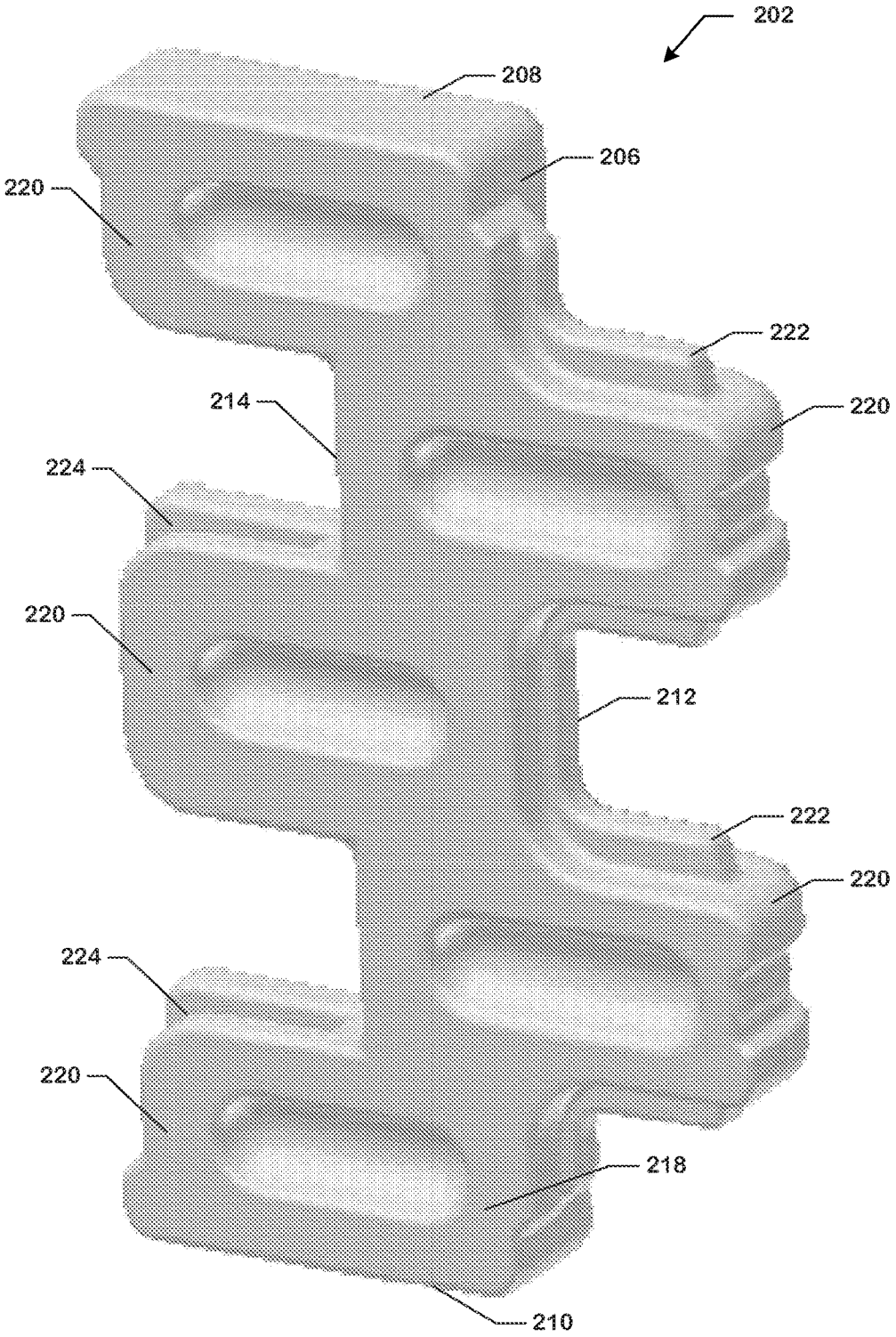
Figure 15:
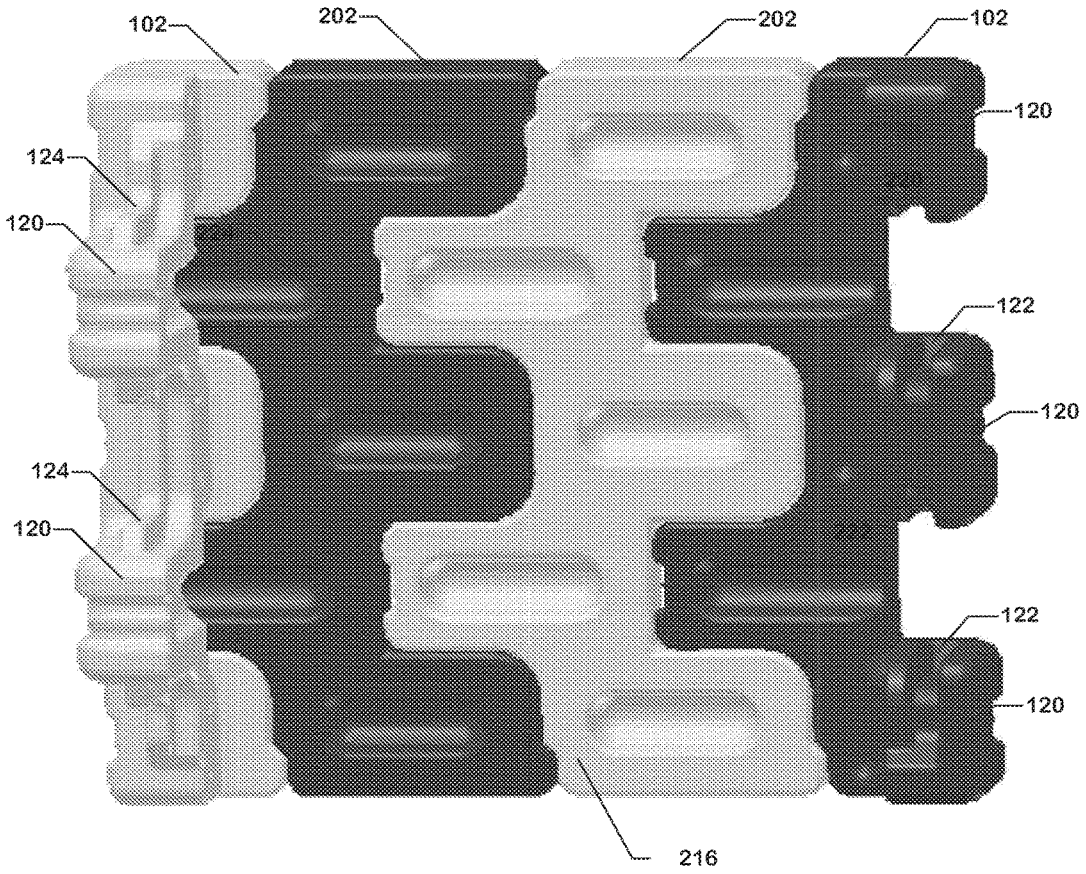
Figures 16A, 16B, 16C:
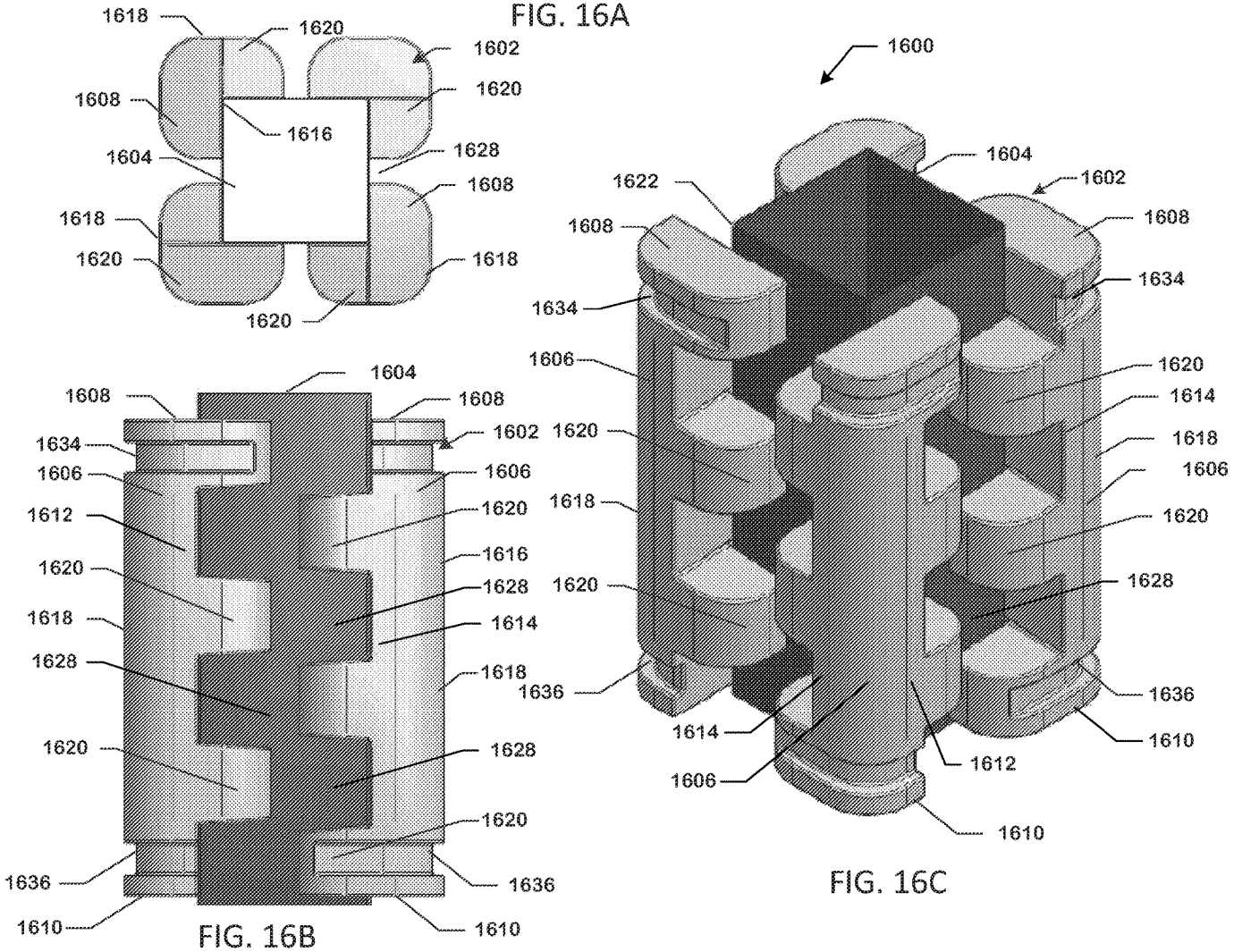
Figures 17A, 17B, 17C:
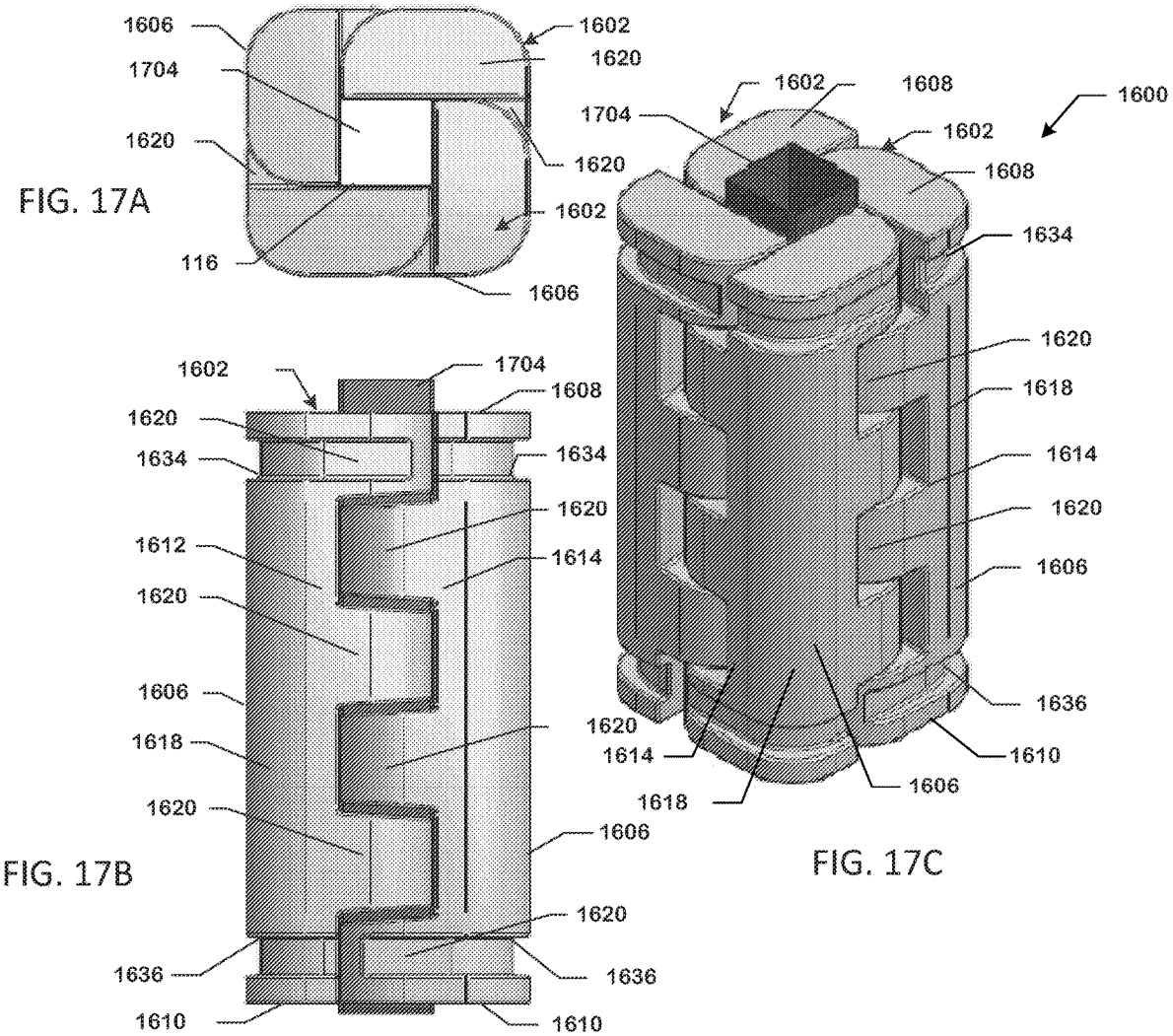
Figure 18A:
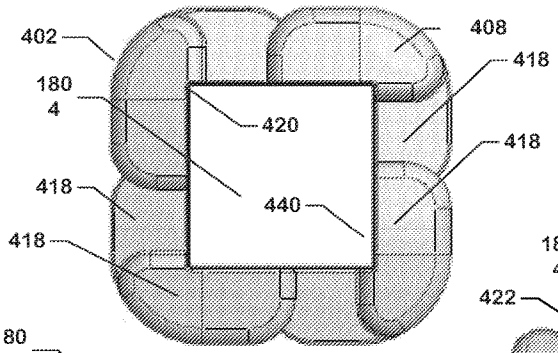
Figure 18C:
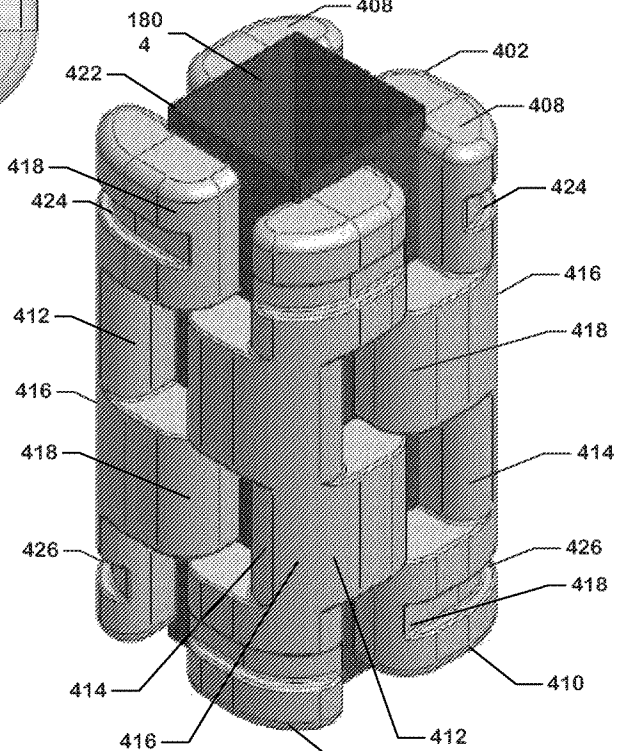
Figure 18B:
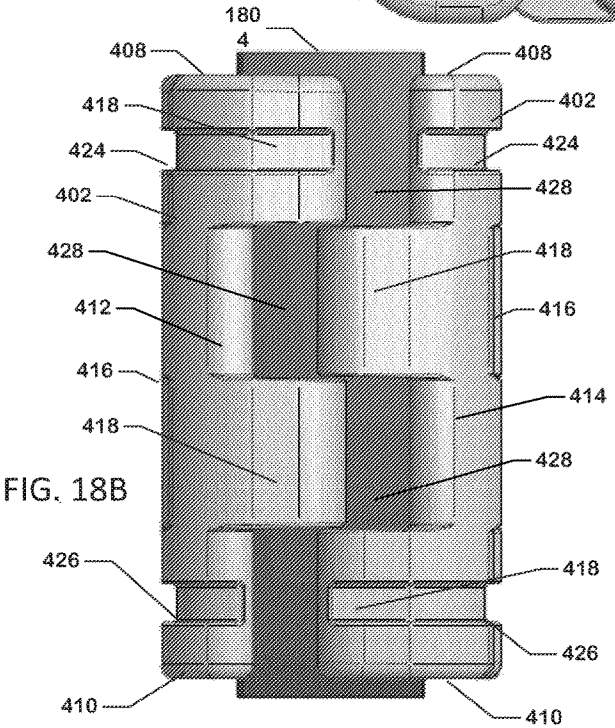
Figures 19A, 19B, 19C:
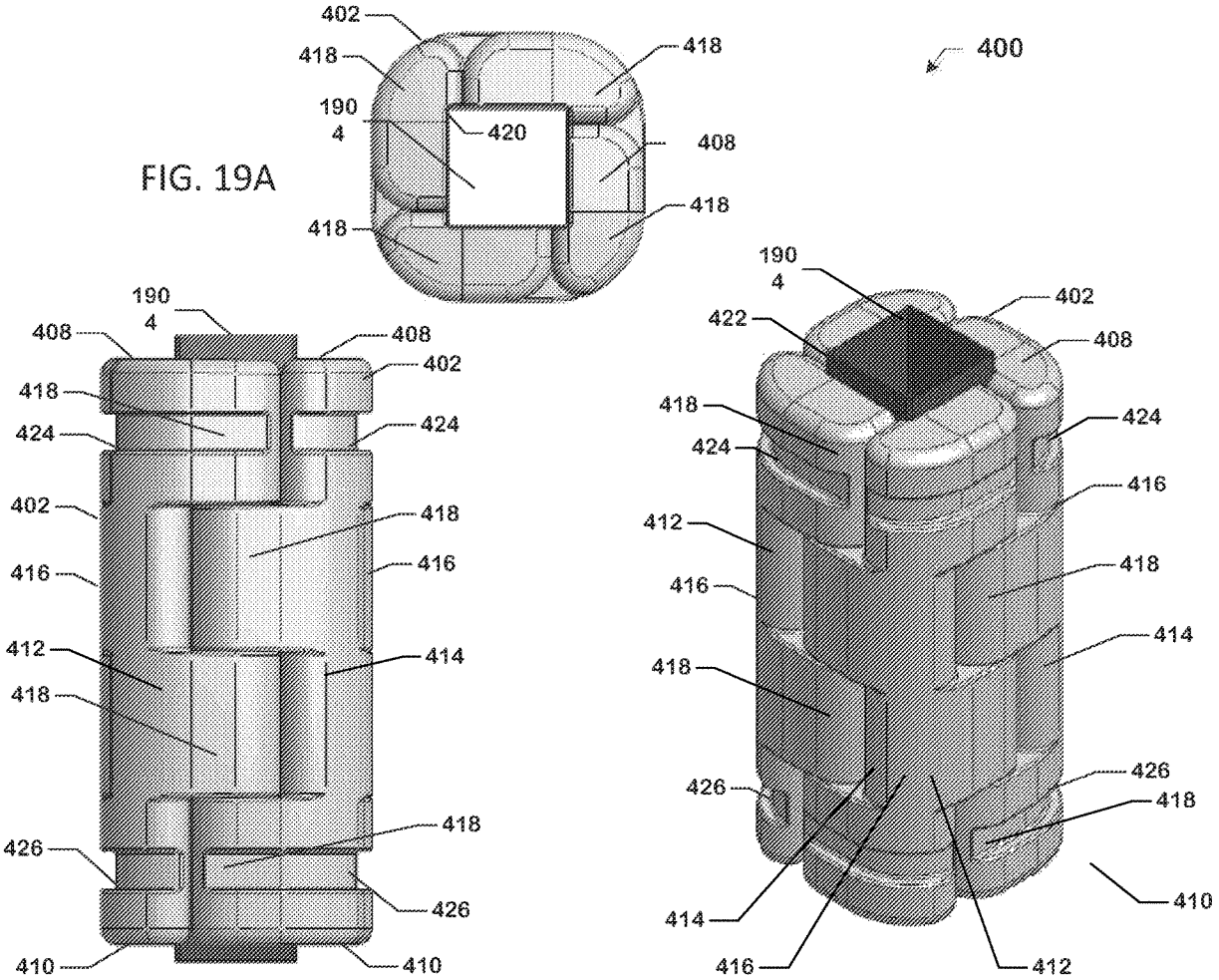
Figures 20A, 20B, 20C, 20D, 20E, 20F:
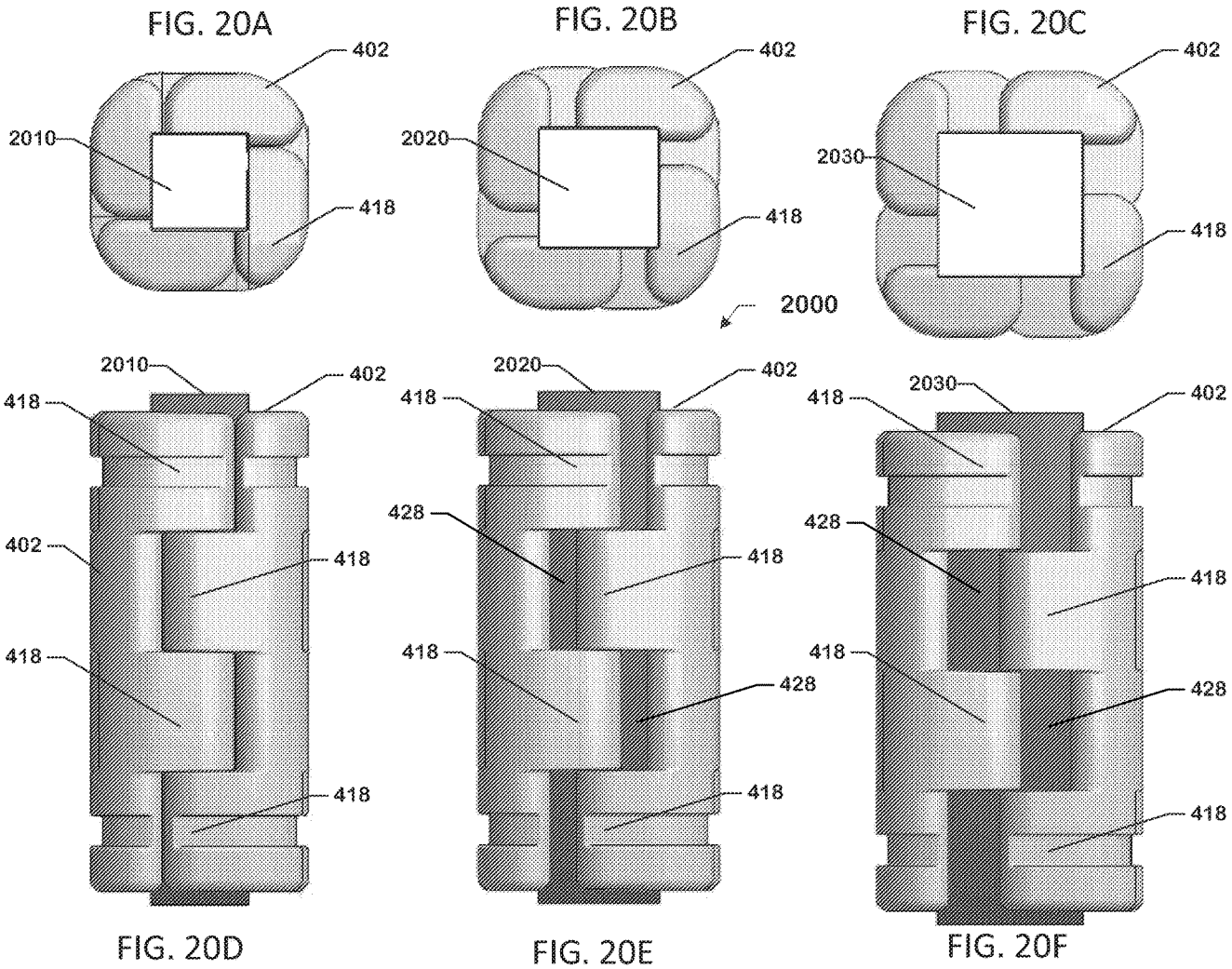
Figure 21:
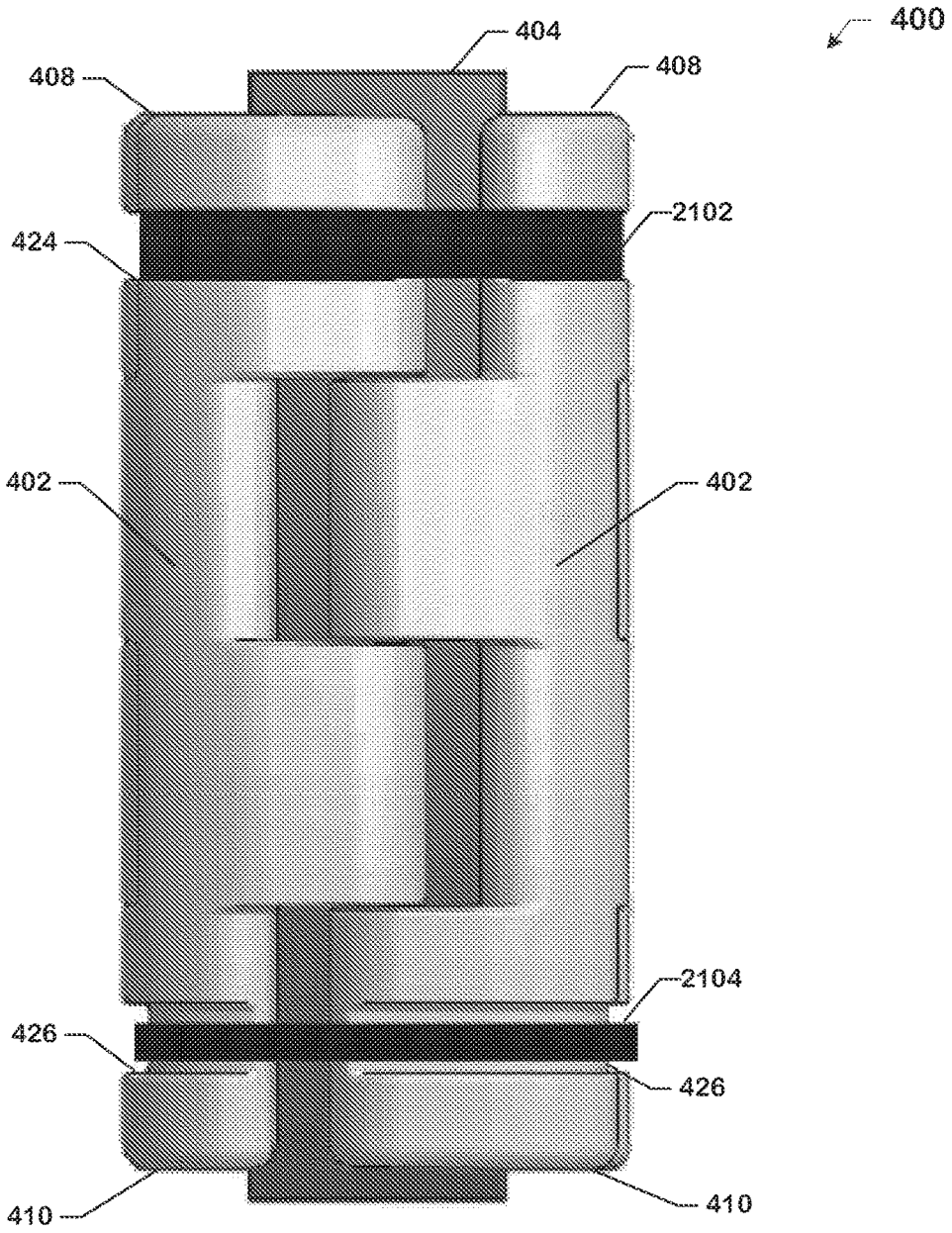
Figure 22:
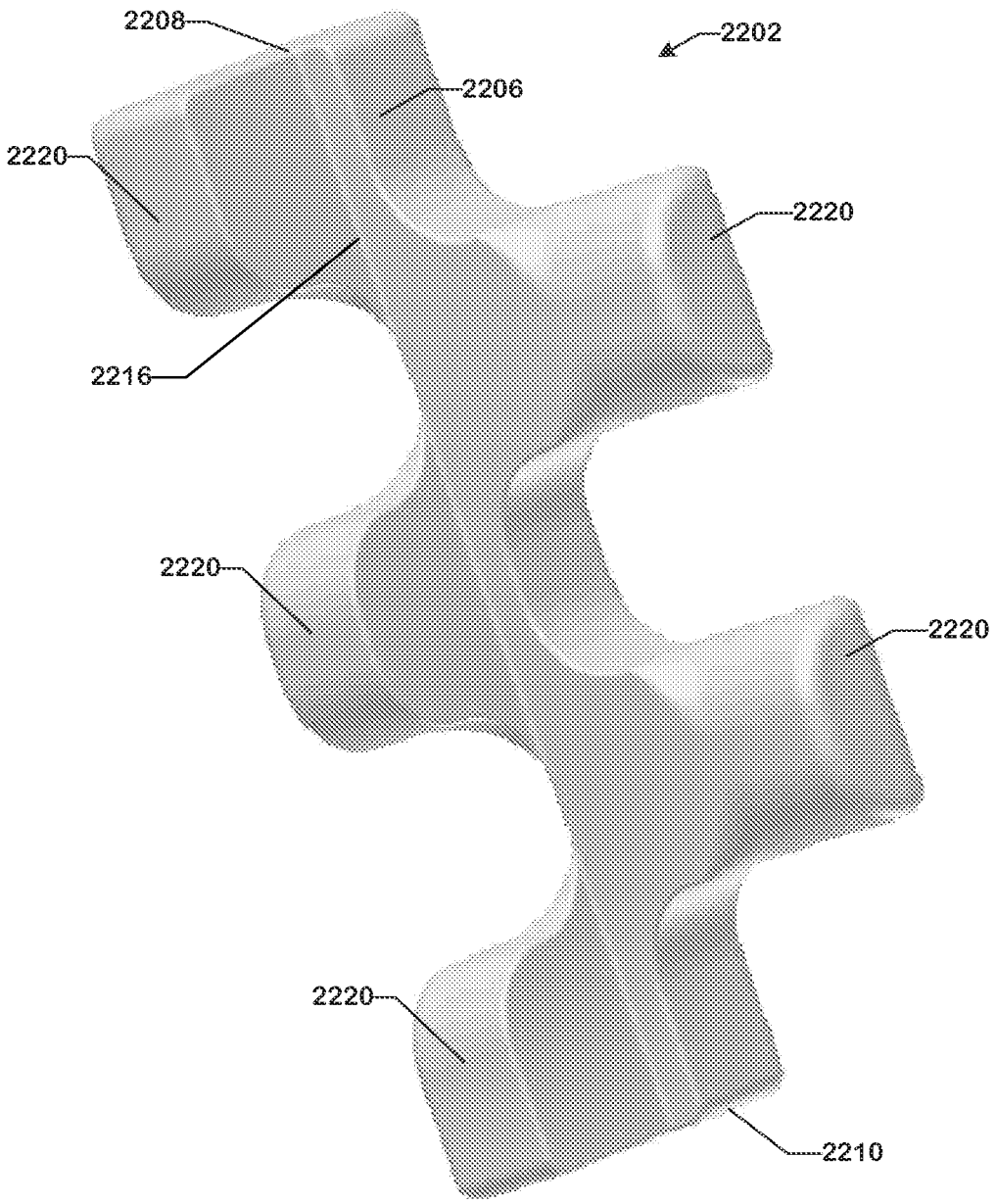
Figure 23:
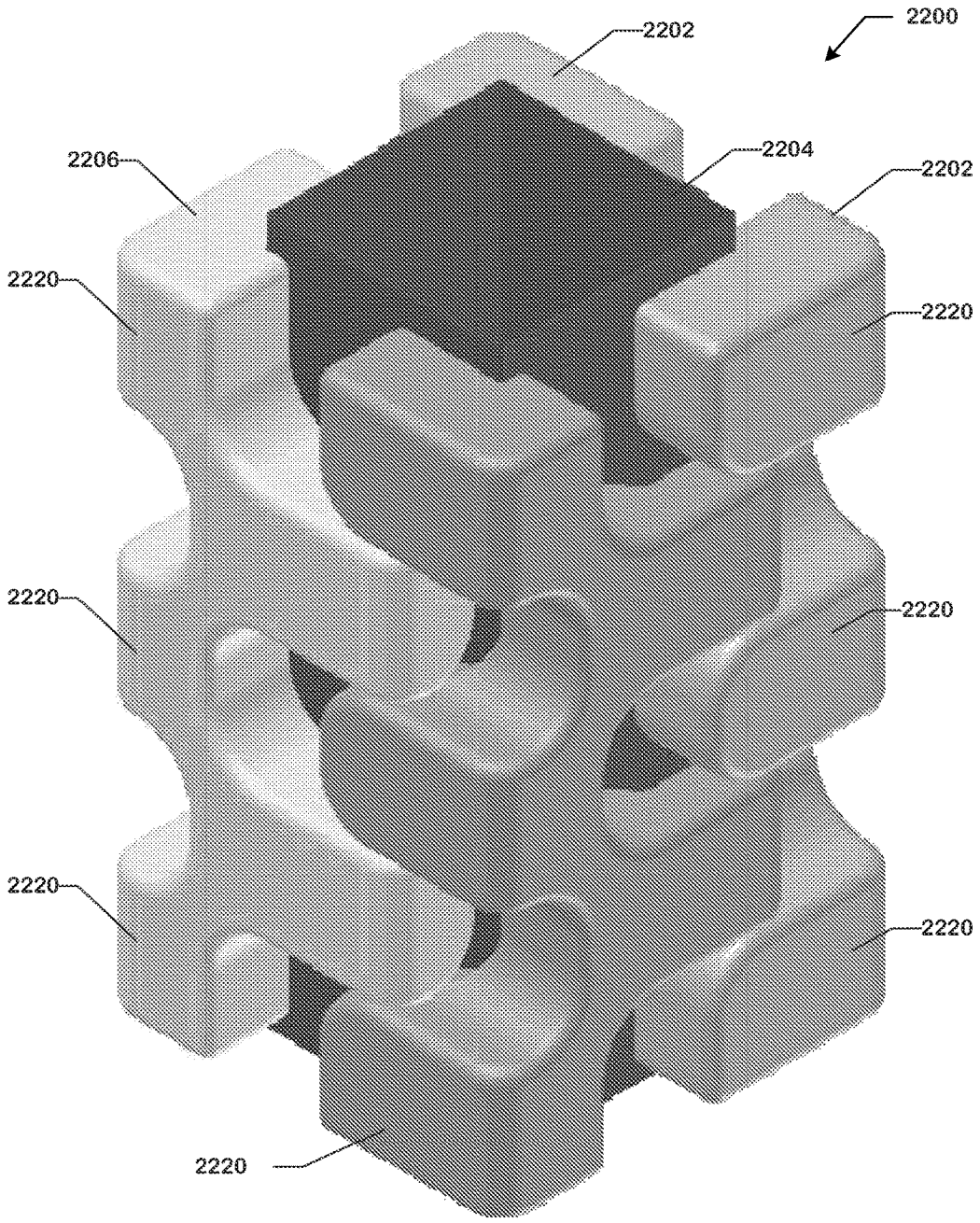

5A-5E are illustrations of cross-sectional top views of exemplary embodiments of the a column protection system in accordance with aspects of the disclosure;

FIG. 6 is an illustration of an exemplary embodiment of a column protection system in accordance with aspects of the disclosure;

FIG. 7 is an illustration of an exemplary embodiment of a column protection system in accordance with aspects of the disclosure;

FIGS. 8-9 are illustrations of top views of exemplary embodiments of column protection systems in accordance with aspects of the disclosure;

FIG. 10 is an illustration of a cross-sectional side view of an exemplary embodiment of a column protection system in accordance with aspects of the disclosure;

FIG. 11 is an illustration of an exemplary embodiment of a column protection system in accordance with aspects of the disclosure;

FIG. 12 is an illustration of an exemplary embodiment of a column protection system in accordance with aspects of the disclosure;

FIG. 13 is an illustration of an exemplary embodiment of a column protection system in accordance with aspects of the disclosure;

FIG. 14 is an illustration of an exemplary embodiment of a column protector in accordance with aspects of the disclosure;

FIG. 15 is an illustration of an exemplary embodiment of a column protection system in accordance with aspects of the disclosure;

FIGS. 16A-16C are illustrations of a cross-sectional top view, a side view and a perspective view of an exemplary embodiment of a column protection system;

FIGS. 17A-17C are illustrations of a cross-sectional top view, a side view and a perspective view of the column protection system shown in FIGS. 15A-15C;

FIGS. 18A-18C are illustrations of a cross-sectional top view, side view and perspective view of an exemplary embodiment of a column protection system;

FIGS. 19A-19C are illustrations of a cross-sectional top view, side view and perspective view of the column protection system shown in FIGS. 18A-18C;

FIGS. 20A-20F are illustrations of cross-sectional top views, and side views of exemplary embodiments of a column protection system;

FIG. 21 is an illustrations of a side view of a column protection system in accordance with aspects of the disclosure;

FIG. 22 is an illustration of a perspective view of an exemplary embodiment of a column protector in accordance with aspects of the disclosure; and FIG. 23 is an illustration of a perspective view of an exemplary embodiment of a column protection system in accordance with aspects of the disclosure.

It should be noted that all the drawings are diagrammatic and not drawn to scale. Relative dimensions and proportions of parts of these figures have been shown exaggerated or reduced in size for the sake of clarity and convenience in the drawings. The same reference numbers are generally used to refer to corresponding or similar features in the different embodiments. Accordingly, the drawing(s) and description are to be regarded as illustrative in nature and not as restrictive.

DETAILED DESCRIPTION

For the purposes of this disclosure, the term "column" refers to any of a structural support, building column, pole, post, square column, rectangular column, round column, I-beam and/or H-column, or most any elongated structure that may benefit from impact protection. For example, a structural support column, a beam, a sign post, a pallet rack leg and a mezzanine support are columns.

Figure 1:
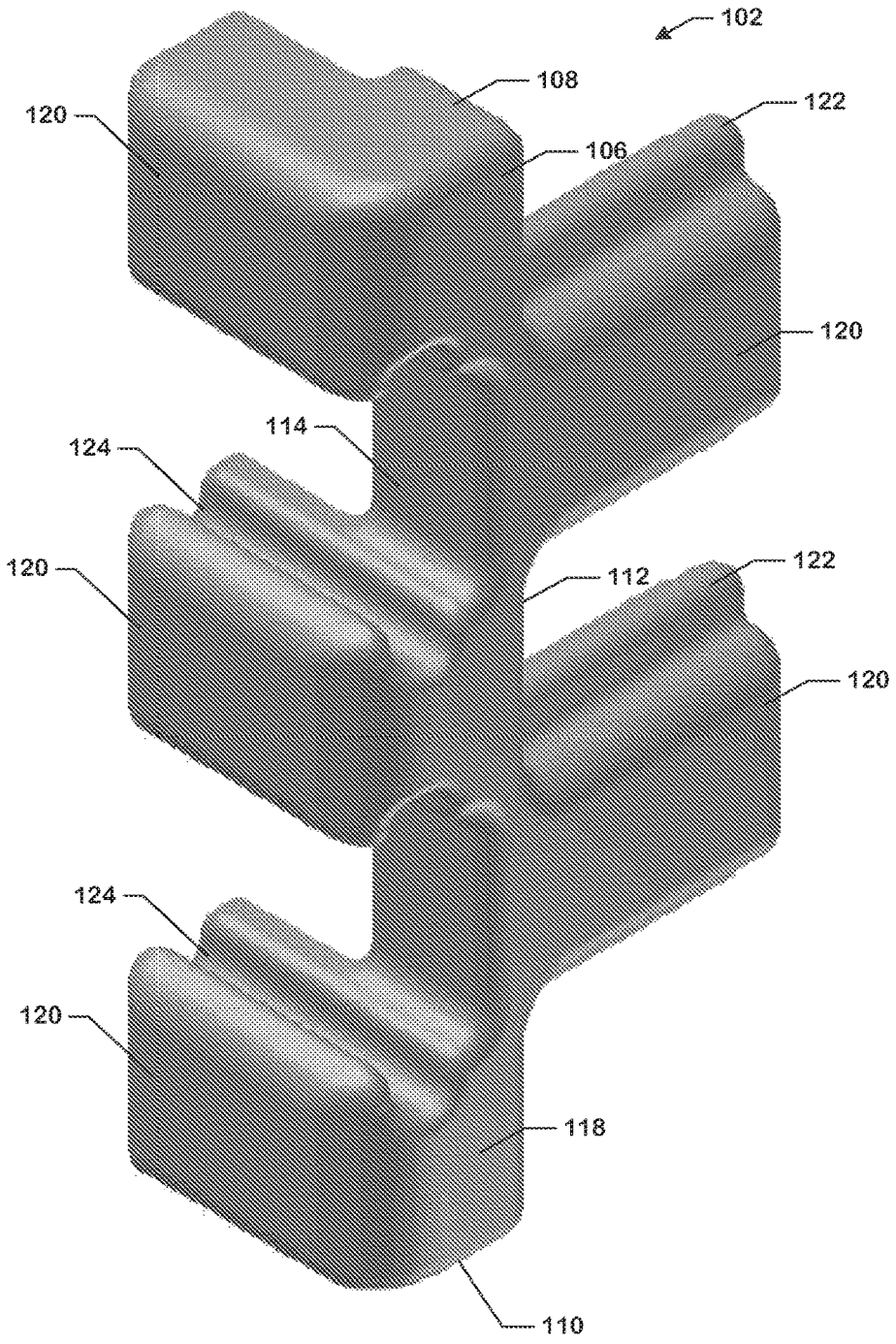
FIG. 1 is an illustration of an exemplary embodiment of a column protector in accordance with aspects of the disclosure.
Figure 2:
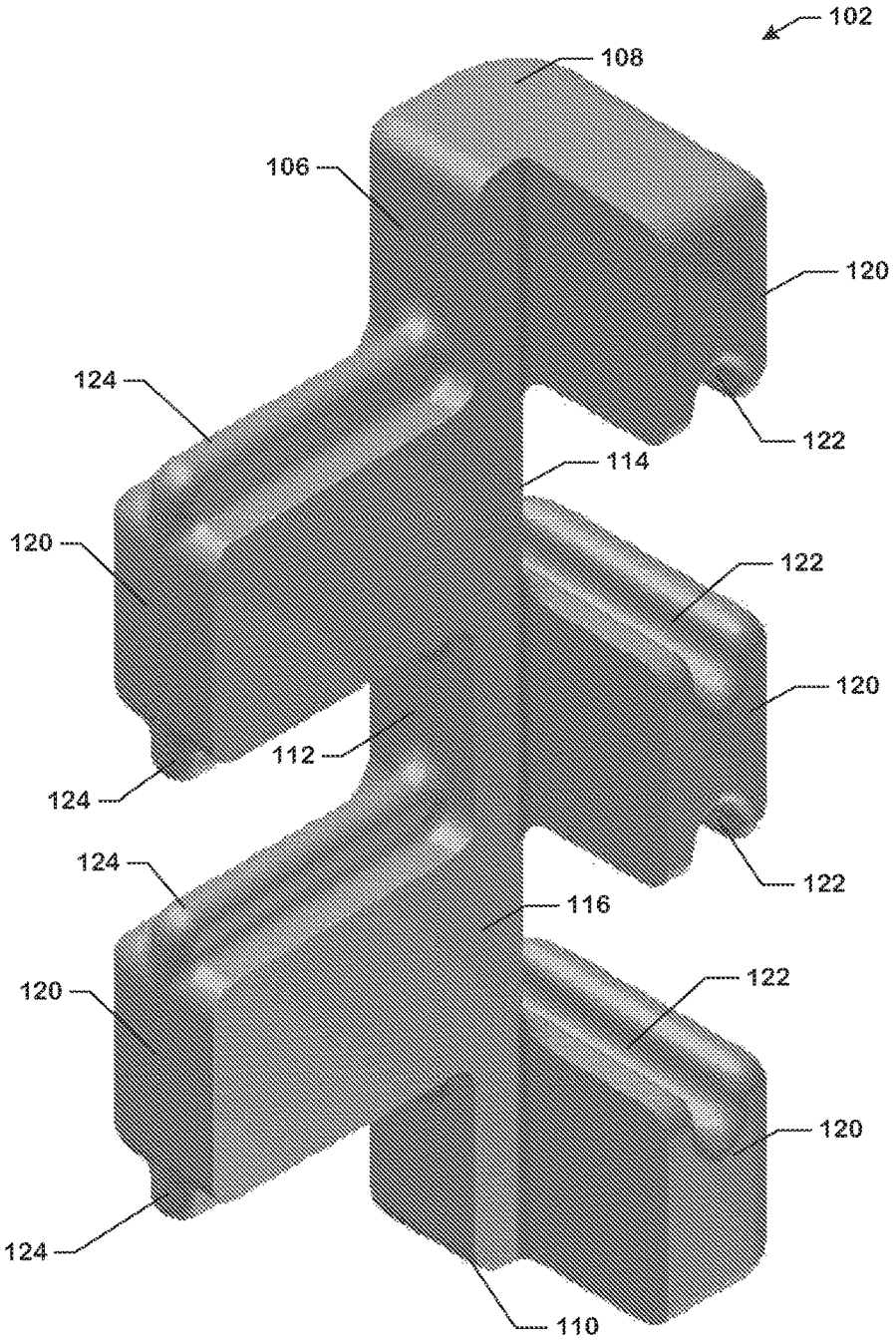
FIG. 2 is an illustration of an exemplary embodiment of a column protector in accordance with aspects of the disclosure.

As shown in FIGS. 1-2, a protector component 102 includes a body 106 having a length that includes opposing end portions 108, 110, opposing side portions 112, 114, an inner surface 116, and an outer surface 118. The column protection system 100 absorbs and deflects energy from an impact thereby lessening or preventing damage to the column 104, equipment and/or personnel.

The protector component 102 includes projections 120, along the length of the body 106 that extend away from the side portions 112, 114 of the body 106. End portions 108, 110 can include recessed areas or indentations for accepting a securing mechanism.

The projections 120 extend away from the corresponding body 106 at an angle relative thereto. In an embodiment, projections 120 are equally spaced along the opposing side portions 112, 114 of the body 106. The projections 120 of a first side portion 112 of the body 106 are offset in the axial direction from the projections 120 of a second side 114 of the body 106. As shown, a plurality of fingers/projections 120 are orthogonally-oriented and are spaced along a length of the body 106.

The fingers/projections 120 can extend at right angles to the body 106; however, in other embodiments, the projections 120 may extend from the body 106 at most any orientation depending upon the shape of the column 104 to be protected and the direction of expected impact. Projections 120 of a first side portion 112 extend of the body 106 in an alternating arrangement with, or are otherwise offset from, the projections 120 of a second side portion 114 of the body 106.

The protector component 102 can include integrally formed connectors arranged for meshing, sliding and/or interlocking engagement with at least one adjacent protector member 102. In an embodiment, projection 120 can include integrally formed connectors arranged for sliding and/or interlocking engagement with at least one projection 120 of an adjacent protector member 102. In an embodiment, the connectors comprise corresponding ribs 122 and channels 124 that interlock or otherwise slidingly engage, wherein each channel is sized for insertion of a rib 122 of an adjacent protector component 102. In an aspect, the integrally formed connectors or features are shaped and sized to structurally interlock the protector components 102 together, or to otherwise provide sliding engagement.

In other embodiments, the connectors can include most any size and shape interlocking, connecting or meshing means capable of a mating relation, and sufficient to structurally interconnect or otherwise mesh the protector components 102. For example, the connectors can include any of a tongue and groove, post and socket, dovetail, or other similar connecting means.

The interlocking engagement of the integrally formed connectors of the projections 120 of a protector component 102 provides support to the projections 120 of an adjacent protector component 102 thereby increasing the impact resistance of the protection system 100. The protection system 100 is particularly effective for use with an H-column or I-beam whose configuration creates a void, for example, behind a portion of the interlocked fingers 120 of the protection components 102. In the areas where the protection system 100 is not backed by a portion of the column, the interlocked arrangement of the projections 120 lends support to adjacent projections 120, and constrains the inward and outward movement of the projections 120 thereby retaining the column protection in place. This synergistic effect of interlocked projections 120, and interlocked protection components 102, provides a considerably enhanced level of protection over conventional systems whose structural strength cannot generally withstand the force of an impact, and tend to either move out of the way or collapse at impact when not supported from behind by the column.

The inner portion 116 of the protector component 102 is shaped to accept a portion of a column 104. In aspects, the protector component 102 is resiliently pliable so as to conform to an outer portion of a column. In an embodiment, the inner portion 116 of protector component 102 is shaped to accept a corner of a column 104 having a generally square or rectangular cross-section. In aspects, the inner portion 116 of the protector component 102 can be shaped to accept a column having a generally square or rectangular cross-section. In embodiments, the inner portion 116 of the protector component 102 can be shaped to accept a pole or post having a generally circular or oval cross-section. In further embodiments, the inner portion 116 of the protector component 102 can be shaped to accept most any column, support structure or post including, for example, an I-beam or an H-beam.

The protector component 102 is comprised of a semi-rigid, resilient, deformable material. In an embodiment, each protector component 102 forms a semi-flexible, molded unitary member. The protector component 102 has a thickness and can be made of a plastic material, for example, polypropylene, polyurethane, polyethylene polystyrene copolymers such as acrylonitrile-butadiene-styrene copolymer (ABS), vinyl or recycled plastics. In an embodiment, protector component 102 is comprised of post-industrial recycled polyethylene. In an installed position, protector component 102 conforms to the shape of the column due at least in part to the configuration of inner portion 116 and the flexibility of the material.

In an embodiment, the protector component 102 includes a hollow interior and can include openings sized such that air can escape from the interior when the protector component 102 is contacted and compressed. In other embodiments, a hollow interior of protector component 102 can be can be filled utilizing, for example, a gel, foam, polymeric, and/or viscoelastic material, which can increase the load absorbing properties of the protector component 102.

Figure 3:
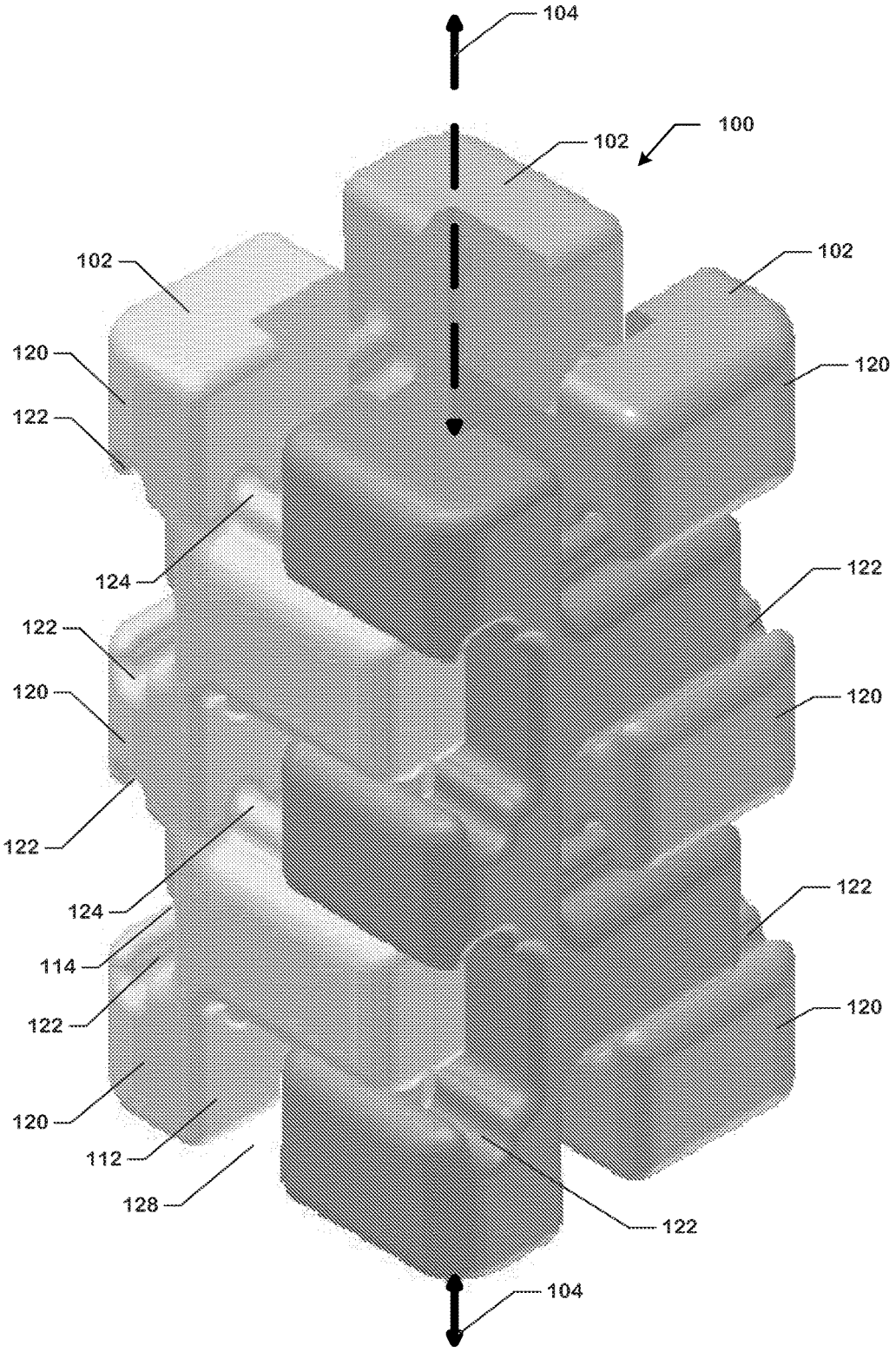
FIG. 3 is an illustration of an exemplary embodiment of a column protection system in accordance with aspects of the disclosure.
Figure 4:
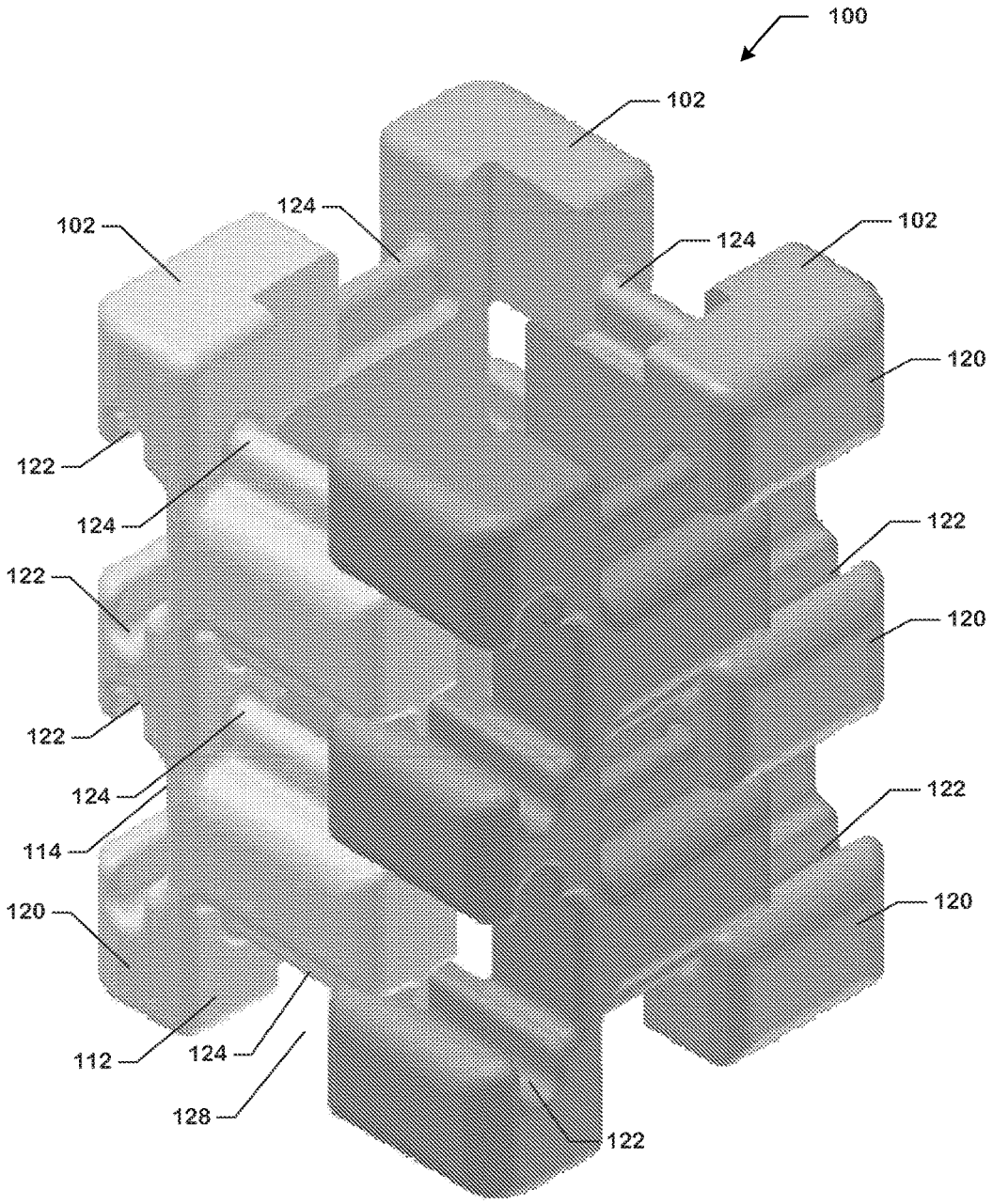
FIG. 4 is an illustration of an exemplary embodiment of a column protection system in accordance with aspects of the disclosure.
Figure 5C:
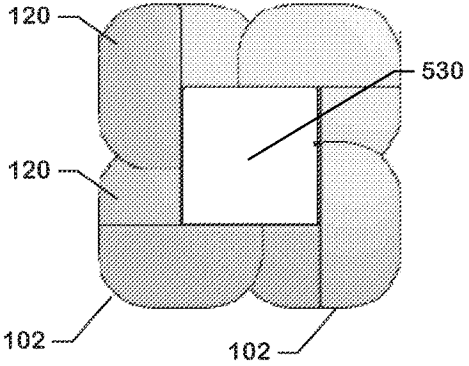
Figure 5B:
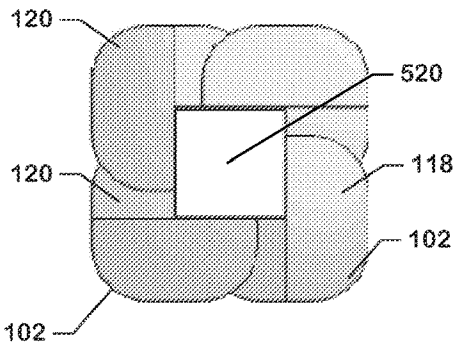
Figure 5A:
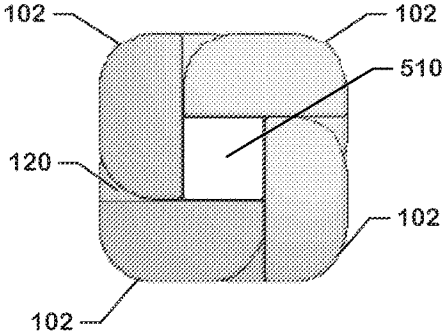
Figure 5E:
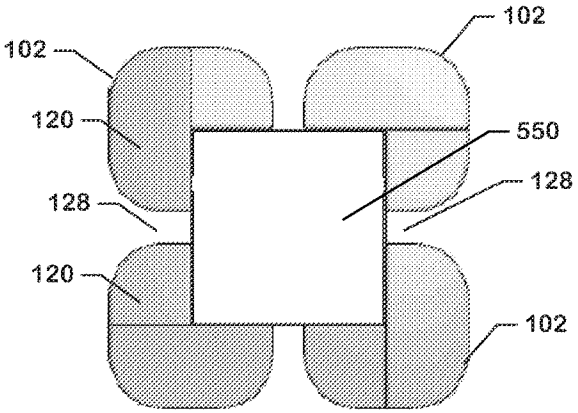
Figure 5D:
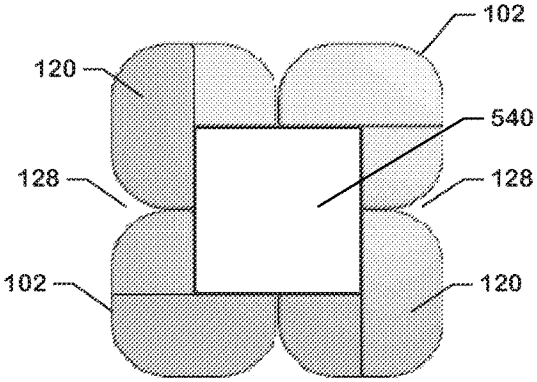

Referring to FIGS. 3-4, an exemplary embodiment of a column protection system 100, can include protector components 102 secured to a column. The column protection system 100 comprises a resilient system that absorbs and redistributes energy, and helps protect people, equipment, and support structures from damage due to impact, in a warehouse or similar environment. The column protection system 100 can absorb and deflect impacts from external forces such as a bump or crash, while maintaining the structural integrity of a column 104 by protecting it from damage.

Column protection system 100 is useful for safeguarding columns, posts, beams and structural supports and helps reduce costs associated with building repairs due to accidental collisions. Column protection system 100 substantially surrounds a portion of the column protecting it from damage at most all angles, and can serve to protect equipment such as tow motors, forklifts and pallet jacks, as well as their operators. The column protection system 100 provides the combined properties of impact absorption, cost effectiveness and ease of installation.

The column protection system 100 provides a significant improvement over traditional column protectors which are designed and sized to fit a specific column configuration. Traditional column protectors are generally unsuitable for use with columns or supports having dissimilar or irregular dimensions. The protective features of traditional column protectors can be less effective when installed on columns of different sizes. Additionally, the column protection system 100 provides a significant improvement over conventional non-molded, flexible column covers that are thin so as to wrap around a column and, thus, do not provide the same level of protection as a resilient molded component.

The column protection system 100 includes protector components 102 substantially surrounding a column 104, wherein the projections 120 extend away from a first side portion 112 of the body 106 of a first protector component 102 and towards the second side portion 114 of an adjacent protector component 102. In aspects, the projections 120 of a first side portion 112 of the protector component 102 can alternate, in an interlocked arrangement, with the projections 120 of a second side portion 114 of an adjacent protector component 102.

Still referring to FIGS. 3-4, when column protection system 100 is installed on a column 104, projections 120 of the protector component 102 engage in an interlocked arrangement with the projections 120 of an adjacent protector component 102. When column protection system 100 is installed on a column 104 having a relatively larger cross-section, the projections 120 of the protector component 102 engage with the projections 120 of an adjacent protector component 102 forming spaces therebetween, as shown, while still providing protection from impact. In an embodiment, the spaces formed between projections 120 are the same, or similar, width as the projections 120, and the length of the spaces increases as the column cross-section increases.

In aspects, the projections 120 of a first side portion 112 and the projections 120 of a second side portion 114 are generally parallel, and the spaces defined therebetween are substantially the same width as the projections. In other embodiments, the projections 120 of protector component 102 abut, or converge with, the projections 120 of an adjacent protector component 102 in close proximity. The projections 120 can comprise most any shape and size depending upon the shape of the column to be protected and the direction of expected impact.

FIG. 4 illustrates an exemplary embodiment of a column protection system 100, wherein the column protection system 100 is adapted for protecting a column having a relatively larger cross-section when compared to the column protection system 100 shown in FIG. 3. Protector components 102 of the column protection system 100 of FIG. 4 are of the same or similar dimensions as protector components 102 of the column protection system 100 illustrated in FIG. 3, thereby demonstrating an aspect of the adaptability of the column protection system 100. That is, the interchangeable protector components 102 can provide impact protection for a range of column sizes.

The projections 120 of the protector component 102 converge in close proximity to the projections 120 of an adjacent protector component 102, when the column protection system 100 is installed on a column having a relatively smaller cross-section, as shown in FIG. 3. When column protection system 100 is installed on a column 104 having a relatively larger cross-section, the projections 120 of the protector component 102 engage, in an interlocked arrangement, with the projections 120 of an adjacent protector component 102 forming spaces 128 therebetween, as shown in FIG. 4, while still providing protection from impact. In an embodiment, the spaces 128 formed between projections 120 are the same, or similar, width as the projections 120, and the length of the spaces 128 increases as the column cross-section increases. In aspects, the projections 120 of the first side portion 112 and the projections 120 of the second side portion 114 are generally parallel, and the spaces defined therebetween are substantially the same width as the projections.

The column protection system 100 includes protector components 102 secured to a column 204, wherein projections 120 extend away from the body 106 of a first protector component 102 and towards a body 106 of an adjacent protector component 102. When installed on a column having a relatively smaller cross-section, the projections 120 of a first side portion 112 are in close proximity to, and are interlocked with, the projections 120 of a second side portion 114 of an adjacent protector component 102. In aspects, the projections 120 of a first side portion 112 alternate and are interlocked with the projections of a second side portion 114 of an adjacent shaped component 102.

The engagement between the ribs 122 and channels 124 of the fingers 120 serve to connect the protector components 102 together such that the inward/outward motion of an interlocked or meshed protector component 102 is constrained by the adjacent protector component 102. Each interlocked protector component 102 provides reinforcement to the adjacent protector component 102, thereby increasing the impact protection strength of the column protection system 100. Each interlocked or meshed protector component 102 provides reinforcement to the adjacent protector component 102, thereby providing support and limiting inward movement of the protector components 102 toward the column 104, and outward movement away from the column 104, thereby increasing the impact protection strength of the column protection system 100.

In an embodiment, the protector component 102 can include fingers 120 integrally formed and arranged for sliding and/or interlocking engagement with fingers 120 of at least one adjacent protector member 102. In an embodiment, fingers 120 can be arranged for telescopic engagement with at least one finger 120 of an adjacent protector member 102. For example, finger 120 can comprise an inner piece configured for slidable engagement and insertion into a corresponding outer piece, finger 120 of an adjacent protector component. The finger 120 of the adjacent protector component comprises a corresponding outer piece shaped and sized to accept the inner piece, thereby providing sliding, telescopic engagement and structurally interlocking the protector components 102 together.

The column protection system 100 includes four similarly proportioned and interchangeable protector components 102. The protector components 102 can be identical, or similar, to one another and are interchangeable. In aspects, with respect to end portions 108, 110, the protector component 102 is top to bottom symmetrical. That is, the protector component 102 looks and functions the same way when the positions of the end portions 108, 110 are reversed. The features of interchangeability and reversibility of the protector components 102 increase the ease of installation of the column protection system 100, and reduce production, inventory, and installation costs of the column protection system 100.

In an embodiment, protector component 102 can have a length between two feet and six feet. In aspects, the protector component comprises a length of about forty-two inches. In further embodiments, the column protection system 100 can be most any length that provides a column with impact protection. The column protection system 100 can be installed at a height on a column determined to be most effective for preventing damage from an impact. In aspects, a column protection system 100 can comprise two or more groups of four protector components 102 installed on a column 104 at a height, or at various heights, to provide multiple areas of protection, or a continuous line of protection, along a length or portion of a column.

In an embodiment, the column protection system 100 may be easily installed on a column 104 utilizing the interlocking connector means without the use of tools or the like, and without the need for additional securing mechanisms. The connectors, for example, corresponding ribs 122 and channels 124, can interlock so as to provide a friction fit that secures the column protection system 100 to the column. That is, the surfaces of the ribs 122 make friction contact with the channels 124. The friction contact can secure the protector components 102 to each other, and to the column.

FIGS. 5A-5E illustrate a cross-sectional top view of an exemplary embodiment of a column protection system 100, wherein identical, or similar, protector components 102 are secured to columns 510, 520, 530, 540, 550 having generally square cross-sections of varying sizes. FIGS. 5A-5E demonstrate the adaptability of the column protection system 100, for example, a single size protector component 102 can provide protection for a range of column sizes 510, 520, 530, 540, 550 as shown.

Depending on the size of the column, the projections 120 of a protector component 102 may touch, abut, or be in close contact with the projections of an adjacent protector component 102. The projections 120 of adjacent protector components 102 are in close proximity when installed on a column 510 having a relatively smaller cross-section x. When installed on increasingly larger columns 520, 530, 540, 550, having cross-sections greater than x, the projections 120 form spaces 128 therebetween.

A column protection system 100 is shown installed on a relatively smaller column 510. The projections 120 of each protector component 102 converge with and abut the projections 120 of the adjacent protector component 102 in close proximity. When the column protection system 100 is installed on progressively larger columns 520, 530, 540, 550, the projections 120 of each protector component 102 continue to engage the projections of the adjacent shaped component, forming increasing spaces 128 therebetween, as the column size increases. At a relatively larger diameter column 550, projections 120 continue to provide protection to the column due at least in part to the size, material, shape and arrangement of the projections 120.

In an embodiment, a column protection system 100 can protect a relatively smaller column having a cross-section or width x, and can also provide protection for a larger column having a cross-section or width of up to 2.5× or more. For example, the same column protection system can be used on columns having widths of six inches, eight inches, ten inches, twelve inches, fourteen inches, sixteen inches, or greater.

Because a single sized protector component 102 can be used to protect columns 510, 520, 530, 540, 550 in a vast array of sizes, the need to produce, hold in inventory, measure, or order a column protection system of a specific size is reduced or eliminated. In aspects, the protector components 102 are interchangeable and can be manufactured, stocked and sold in bulk. The protector components 102 that comprise the adaptable protection system 100 can also be purchased and installed in bulk without having to sort through or match a particular protector component 102 to a particular size column 510, 520, 530, 540, 550, thereby increasing efficiency and decreasing costs. Further, the column protection system 100 can be utilized with a particular size column in one instance, and can then later be re-used to effectively protect another column of a different size without modification.

Referring to FIGS. 6-7, embodiments of the column protection system 100 include protector components 102 substantially surrounding a column. The protector components 102 can include integrally formed connectors arranged for meshing, sliding, and/or interlocking engagement with at least one adjacent protector member 102. In an embodiment, projection 120 can include integrally formed connectors arranged for sliding and/or interlocking engagement with at least one projection 120 of an adjacent protector member 102. In an embodiment, the connectors comprise corresponding ribs 122 and channels 124 that interlock or otherwise slidingly engage, wherein each channel is sized for insertion of a rib 122 of an adjacent protector component 102. In an aspect, the integrally formed connectors or features are shaped and sized to structurally interlock the protector components 102 together, or to otherwise provide sliding engagement. The adjustability of the sliding engagement of the protector components 102 allows protector components 102 having the same proportions to be utilized for impact protection on a range of column sizes.

FIGS. 8-9 illustrate top views of exemplary embodiments of a column protection system 100, wherein identical, or similar, protector components 102 can be secured to columns having generally square cross-sections of varying sizes. This demonstrates the adaptability of the column protection system 100, for example, a single size protector component 102 can provide protection for a range of column sizes as shown.

With reference to the cross-sectional view illustrated in FIG. 10, the protector component 102, of the column protection system 100, can include integrally formed connectors arranged for meshing, sliding, and/or interlocking engagement with at least one adjacent protector member 102. In an embodiment, projection 120 can include integrally formed connectors arranged for sliding and/or interlocking engagement with at least one projection 120 of an adjacent protector member 102. In an embodiment, the connectors comprise corresponding ribs 122 and channels 124 that interlock or otherwise slidingly engage, wherein each channel is sized for insertion of a rib 122 of an adjacent protector component 102. In an aspect, the integrally formed connectors or features are shaped and sized to structurally interlock the protector components 102 together, or to otherwise provide sliding engagement.

In other embodiments, fingers 120 can be arranged for telescopic engagement with at least one finger 120 of an adjacent protector member 102. For example, finger 120 can comprise an inner piece configured for slidable engagement and insertion into a corresponding outer piece, finger 120 of an adjacent protector component. The finger 120 of the adjacent protector component comprises a corresponding outer piece shaped and sized to accept the inner piece, thereby providing sliding, telescopic engagement and structurally interlocking the protector components 102 together.

In the exemplary embodiment shown in FIG. 10, the protector component 102 includes a hollow interior and can include openings sized such that air can escape from the interior when the protector component 102 is contacted and compressed. In other embodiments, a hollow interior of protector component 102 can be can be filled utilizing, for example, a gel, foam, polymeric, and/or viscoelastic material, which can increase the load absorbing properties of the protector component 102.

Referring to FIGS. 11-12, an exemplary embodiment of a column protection system 100 includes protector components 102 substantially surrounding a column, wherein the arms 120 extend away from a first side portion 112 of the body 106 of a first protector component 102 and towards the second side portion 114 of an adjacent protector component 102. In aspects, the arms 120 of a first side portion 112 of the protector component 102 alternate, and engage in an interlocked and sliding arrangement, with the arms 120 of a second side portion 114 of an adjacent protector component 102.

When installed on a column, the arms 120 of the protector components 102 engage with the arms 120 of adjacent protector components 102, forming spaces 128 therebetween. When column protection system 100 is installed on a column 104 having a relatively larger cross-section, the arms 120 of the protector component 102 engage and interlock with the arms 120 of an adjacent protector component 102 forming spaces therebetween, as shown, while still providing protection from impact. In an embodiment, the spaces formed between arms 120 are the same, or similar, width as the arms 120, and the length of the spaces increases as the column cross-section increases.

FIG. 12 illustrates an exemplary embodiment of a column protection system 100, wherein the column protection system 100 is adapted for protecting a column having a relatively larger cross-section when compared to the arrangement of the column protection system 100 shown in FIG. 11. Protector components 102 of the column protection system 100 of FIG. 12 are of the same or similar dimensions as protector components 102 of the column protection system 100 illustrated in FIG. 11, thereby demonstrating an aspect of the adaptability of the column protection system 100. That is, interchangeable protector components 102 can provide impact protection for a range of column sizes.

The arms 120 of protector component 102 converge in close proximity to the arms 120 of an adjacent protector component 102, when column protection system 100 is installed on a column having a relatively smaller cross-section, as shown in FIG. 11. When column protection system 100 is installed on a column 104 having a relatively larger cross-section, the arms 120 of the protector component 102 engage and interlock with the arms 120 of an adjacent protector component 102 forming spaces 128 therebetween, as shown in FIG. 12, while still providing protection from impact.

FIG. 13 illustrates an exemplary embodiment of a column protection system 1300, wherein protector components 1302 are secured, connected and/or coupled to a column (not shown). The protector components 1302 include recessed areas or indentations 1324, 1326 for accepting a securing mechanism 1332, 1334, for example, a belt or strap. Indentations 1324, 1326 are located at approximately the same position on each of the protector components 1302 so that when the securing mechanisms 1332, 1334 are installed, the protector components 1302 are positioned on a column (not shown).

Securing mechanisms 1332, 1334 can be wrapped around the protector components 1302 at indentations 1324, 1326 and fastened using, for example, a hook and loop closure. Indentations 1324, 1326 are sized to properly locate the securing mechanism 1332, 1334 during installation. Indentations 1324, 1326 aid in keeping the securing mechanisms 1332, 1334 in position while being tightened and prevent the securing mechanisms 1332, 1334 from slipping or moving out of position during use.

Still referring to FIG. 13, securing mechanisms 1332, 1334 can be most any width, length or thickness suitable for securing the protector components 1302 to a column (not shown). In aspects, securing mechanisms 1332, 1334 can include most any fastener, for example, a belt or strap having a hook and loop or other closure, metal cable, elastic cord, shock cord or bungee cord. Securing mechanisms 1332, 1334 can comprise most any strong, flexible material, for example, leather, braided or woven nylon, polyester, polypropylene or polyethylene cord or rope. A cinch strap with a buckle can be utilized as a securing mechanism 1332, 1334.

As shown in FIG. 14, a protector extender component 202 comprises a substantially planar component having a base 206, a length that includes opposing end portions 208, 210, opposing side portions 212, 214, an inner surface 216, and an outer surface 218.

The protector extender component 202 includes projections 220 along the length of the base 206 that extend away from the side portions 212, 214 of the base 206. End portions 208, 210 can include recessed areas or indentations (not shown) for accepting a securing mechanism.

A plurality of projections 220 are spaced along a length of the base 206 of the protector extender component 202. In an embodiment, projections 220 are offset and equally spaced along the opposing side portions 212, 214 if the base 206. The projections 220 of the first side portion 212 of the base 206 are offset in the axial direction from the projections 220 of the second side 214 of the base 206.

In aspects, with respect to end portions 208, 210, the protector extender component 202 is top to bottom symmetrical. That is, the protector component 202 looks and functions the same way when the positions of the end portions 208, 210 are reversed. The features of interchangeability and reversibility of the protector extender component 202 increase the ease of installation of the column protection system 100, and reduce production, inventory, and installation costs associated with the system 100.

The protector extender component 202 can include integrally formed connectors arranged for meshing, sliding and/or interlocking engagement with at least one adjacent protector member 102, and/or another protector extender component 202. In an embodiment, projection 220 can include integrally formed connectors arranged for sliding and/or interlocking engagement with at least one projection 120 of an adjacent protector member 102. Projection 220 can also include integrally formed connectors arranged for sliding and/or interlocking engagement with at least one projection 120 of an adjacent protector extender member 202. In an embodiment, the connectors comprise corresponding ribs 222 and channels 224 that interlock or otherwise slidingly engage, wherein each channel 224 is sized for insertion of a rib 222 of an adjacent protector component 102, or protector extender component 202. In an aspect, the integrally formed connectors or features are shaped and sized to structurally interlock the protector extender components 202 to protector components 102, and/or to other protector extender components 202, and to otherwise provide adjustable, sliding engagement.

The connectors, for example, corresponding ribs 222 and channels 224, can interlock so as to provide a friction fit that secures the column protection system 100 to protector extender components 202 to protector components 102, and/or to other protector extender components 202. That is, the surfaces of the ribs 222 make friction contact with the channels 224. The friction contact can secure the protector extender components to each other, to the protector components 102, and to the column.

In other embodiments, the connectors can include most any size and shape interlocking, connecting or meshing means capable of a mating relation, and sufficient to structurally interconnect or otherwise mesh the protector extender components 202. For example, the connectors can include any of a tongue and groove, post and socket, dovetail, or other similar connecting means.

Referring to FIG. 15, as viewed from the column side, a column protection system 100 can include one or more protector extender components 202 installed between protector components 102. The protector extender component 202 interlocks with other protector extender components 202 and/or protector components 102. The protector extender components 202 can be used together with the protection components 102 to provide protection, for example, for larger square columns, and rectangular, or other non-square columns.

FIGS. 16A-16C illustrate an exemplary embodiment of a column protection system 1600, wherein protector components 1602 are secured to a column 1604. The column protection system 1600 includes a protector component 1602 having a body 1606 having a length that includes opposing end portions 1608, 1610, opposing side portions 1612, 1614, an inner surface 1616, and an outer surface 1618. The protector component 1602 includes projections 1620 along the length of the body 1606 that extend away from the side portions 1612, 1614 of the body 1606. End portions 1608, 1610 include recessed areas or indentations 1634, 1636 respectively, for accepting a securing mechanism.

The projections 1620 extend away from the corresponding body 1606 at an angle relative thereto. In an embodiment, projections 1620 are equally spaced along the opposing side portions 1612, 1614 of the body 1606. The projections 1620 of a first side portion 1612 of the body 1606 are offset in the axial direction from the projections 1620 of a second side 1614 of the body 1606. As shown, a plurality of projections 1620 are orthogonally-oriented and are spaced along a length of the body 1606.

The projections 1620 can extend at right angles to the body 1606; however, in other embodiments, the projections 1620 may extend from the body 1606 at most any orientation depending upon the shape of the column 1604 to be protected and the direction of expected impact. Projections 1620 of a first side portion 1612 extend of the body 1606 in an alternating arrangement with, or are otherwise offset from, the projections 1620 of a second side portion 1614 of the body 1606.

The column protection system 1600 includes protector components 1602 secured to a column 1604, wherein the projections 1620 extend away from a first side portion 1612 of the body 1606 of a first protector component 1602 and towards the second side portion 1614 of an adjacent protector component 1602. In aspects, the projections 1620 of a first side portion 1612 of the protector component 1602 alternate, or are otherwise in non-overlapping arrangement, with the projections 1620 of a second side portion 1614 of an adjacent protector component 1602.

As shown in FIGS. 16A-16C, when column protection system 1600 is installed on a column 1604, projections 1620 of the protector component 1602 engage in non-overlapping arrangement with the projections 1620 of an adjacent protector component 1602, forming spaces 1628 therebetween. When column protection system 1600 is installed on a column 1604 having a relatively larger cross-section, the projections 1620 of the protector component 1602 engage and substantially surround the column 1604, in non-overlapping arrangement together with the projections 1620 of the adjacent protector components 1602 forming spaces 1628 therebetween, as shown, while still providing protection from impact. In an embodiment, the spaces 1628 formed between projections 1620 are the same, or similar, width as the projections 1620, and the length of the spaces 1628 increases as the column cross-section increases.

In aspects, the projections 1620 of a first side portion 1612 and the projections 1620 of a second side portion 1614 are generally parallel, and the spaces defined therebetween are substantially the same width as the projections. In other embodiments, the projections 1620 of protector component 1602 abut, or converge with, the projections 1620 of an adjacent protector component 1602 in close proximity.

The projections 1620 can comprise most any shape and size depending upon the shape of the column 1604 to be protected and the direction of expected impact. In an embodiment, the projections 1620 are substantially the same thickness as the end portions 1608, 1610, and the connecting portion of the protector component 1602. In aspects, the projections 1620 can be tapered at the end.

Still referring to FIGS. 16A-16C, a column protection system 1600 includes four similarly proportioned and interchangeable protector components 1602. The protector components 1602 can be identical, or similar, to one another and are interchangeable. In aspects, with respect to end portions 1608, 1610, the protector component 1602 is top to bottom symmetrical. That is, the protector component 1602 looks and functions the same way when the positions of the end portions 1608, 1610 are reversed.

FIGS. 17A-C illustrate an exemplary embodiment of a column protection system 1600, wherein the column protection system 1600 is secured to a column 1704 having a relatively smaller cross-section when compared to column 1604, shown in FIGS. 16A-C. Protector components 1602 of the column protection system 1600 are of the same or similar dimensions as protector components 1602 of the column protection system 1600 illustrated in FIGS. 16A-C, thereby demonstrating an aspect of the adaptability of the column protection system 1600. That is, interchangeable protector components 1602 can provide impact protection for a range of column sizes 1604, 1704.

The column protection system 1600 includes a protector component 1602 having a body 1606 that includes opposing end portions 1608, 1610, first and second side portions 1612, 1614, an inner portion 1616, and an outer surface 1618. The first side portion 1612, and the second side portion 1614 include projections 1620 extending away from the body 106 of protector component 1602. End portions 1608, 1610 include recessed areas or indentations 1634, 1636 respectively, for accepting a securing mechanism.

The projections 1620 of protector component 1602 converge in close proximity to the projections 1620 of an adjacent protector component 1602, when column protection system 1600 is installed on a column 1704 having a relatively smaller cross-section, than the column 1604 shown in FIGS. 16A-C. When the column protection system 1600 is installed on a column 1704 having a relatively smaller cross-section, the projections 1620 of the protector component 1602 can engage in close proximity and abut the projections 1620 of the adjacent protector components 1602.

FIGS. 18A-18C illustrate an exemplary embodiment of a column protection system 400, wherein protector components 402 are secured to a column 404. The column protection system 400 includes a protector component 402 having a body 416 having a length that includes opposing end portions 408, 410, opposing side portions 412, 414, an inner surface 440, and an outer surface 418. The protector component 402 includes projections 418 along the length of the body 406 that extend away from the side portions 412, 414 of the body 406. End portions 408, 410 include recessed areas or indentations 424, 426 respectively, for accepting a securing mechanism.

As shown in FIGS. 18A-18C, when column protection system 400 is installed on a column 1804, projections 418 of the protector component 402 engage in non-overlapping arrangement with the projections 418 of the adjacent protector components 402, forming spaces 428 therebetween. When column protection system 400 is installed on a column 1804 having a relatively larger cross-section, the projections 418 of the protector components 402 engage and substantially surround the column 404, in non-overlapping arrangement together with the projections 418 of the adjacent protector components 402 forming spaces 428 therebetween, as shown.

FIGS. 19A-C illustrate an exemplary embodiment of a column protection system 400, wherein the column protection system 400 is secured to a column 1904 having a relatively smaller cross-section when compared to column 1804, shown in FIGS. 18A-C. Protector components 402 of the column protection system 400 are of the same or similar dimensions as protector components 402 of the column protection system 400 illustrated in FIGS. 18A-C, thereby demonstrating an aspect of the adaptability of the column protection system 400. That is, interchangeable protector components 402 can provide impact protection for a range of column sizes 1804, 1904.

The projections 418 of protector component 402 converge in close proximity to the projections 418 of an adjacent protector component 402, when column protection system 400 is installed on a column 1904 having a relatively smaller cross-section, than the column 1804 shown in FIGS. 18A-C. When the column protection system 400 is installed on a column 1904 having a relatively smaller cross-section, the projections 418 of the protector components 402 can engage in close proximity and abut the projections 418 of the adjacent protector components 402.

FIGS. 20A-20F illustrate cross-sectional top views and side views of an exemplary embodiment of column protection system 2000, wherein identical, or similar, protector components 402 are secured to columns 2010, 2020, 2030 having generally square cross-sections of varying sizes. FIGS. 20A-20F demonstrate the adaptability of the column protection system 2000, for example, a single size protector component 402 can provide protection from impact for a range of column sizes 2010, 2020, 2030 as shown.

The projections 418 of adjacent protector components 402 are in close proximity to one another when installed on a column 2010 having a relatively smaller cross-section. When installed on increasingly larger columns 2020, 2030, the projections of adjacent elongate shaped components 402 form spaces 428 therebetween, while continuing to provide protection from impact.

The column protection system 2000 is shown installed on a relatively smaller column 2010. The projection 418 of each protector component 402 engage the projections 418 of the adjacent protector component 402 in close proximity. Projections 418 of the protector component 402 may touch or abut the projections 418 of an adjacent protector component 402. When the column protection system 400 is installed on progressively larger columns 2020, 2030, the projections 418 of each protector component 402 continue to engage the projections 418 of the adjacent shaped component forming progressively larger spaces, or spaces 428 therebetween, while continuing to provide the column 2020, 2030 with protection from impact.

The column protection system 400 provides flexibility and functionality to protect a wide variety of columns of differing geometries including standard and non-standard sizes and shapes. The disclosed column protection system 400 also provides adaptability and the ability to change the configuration and functionality of the protector quickly and efficiently. In an embodiment, a column protection system 100 can protect a relatively smaller column 2010 having a cross-section or width x, and can also provide protection for a larger column 2020, 2030 having a cross-section or width of up to about 2.5× or more.

FIG. 21 illustrates an exemplary embodiment of a column protection system 400, wherein protector components 402 are secured, connected and/or coupled to a column 404. End portions 408, 410 include recessed areas or indentations 424, 426 respectively, for accepting a securing mechanism 2102, 2104, for example, a belt or strap. Indentations 424, 426 are located at approximately the same position on each of the protector components 402 so that when the securing mechanisms 2102, 2104 are installed, the protector components 404 are positioned on the column 404.

Securing mechanisms 2102, 2104 can be wrapped around the end portions 408, 410 at indentations 424, 426 and fastened using, for example, a hook and loop closure. Indentations 424, 426 in the end portions 408, 410 are sized to properly locate the securing mechanism 2102, 2104 during installation. Indentations 424, 426 aid in keeping the securing mechanisms 2102, 2104 in position while being tightened and prevent the securing mechanisms 2102, 2104 from slipping or moving out of position during use.

Still referring to FIG. 21, securing mechanisms 2102, 2104 can be most any width, length or thickness suitable for securing the protector components 402 to column 104. In aspects, securing mechanisms 2102, 2104 can include most any fastener, for example, a belt or strap having a hook and loop or other closure, metal cable, elastic cord, shock cord or bungee cord. Securing mechanisms 2102, 2104 can comprise most any strong, flexible material, for example, leather, braided or woven nylon, polyester, polypropylene or polyethylene cord or rope. A cinch strap with a buckle can be utilized as a securing mechanism 2102, 2104.

As an alternative to, or in addition to, securing mechanisms 2102, 2104, the column protection system 400 can be secured to a column 404 utilizing a suitable adhesive, including for example, construction adhesive, glue, epoxy, contact cement, and the like.

As shown in FIG. 22, the protector component 2202 comprises a body 2206 having a length that includes opposing end portions 2208, 2210, an inner surface 2216, and an outer surface 2218 (not shown). The column protection system 2200 absorbs and deflects energy from an impact thereby lessening or preventing damage to a column, equipment and/or personnel.

The protector component 2202 includes projections 2220 along the length of the body 2206 that extend away from the body 2206.

The projections 2220 extend away from the corresponding body 2206 at an angle relative thereto. In an embodiment, projections 2220 are equally spaced along opposing side portions of the body 2206. The projections 2220 of a first side portion of the body 2206 are offset in the axial direction from the projections 2220 of a second side of the body 2206. As shown, a plurality of projections 2220 are orthogonally-oriented and are spaced along a length of the body 2206.

The projections 2220 can extend at right angles to the body 2206; however, in other embodiments, the projections 2220 may extend from the body 2206 at most any orientation depending upon the shape of the column to be protected and the direction of expected impact. Projections 2220 of a first side of the body 2206 extend in an alternating arrangement with, or are otherwise offset from, the projections 2220 of a second side of the body 2206.

FIG. 23 illustrates an exemplary embodiment of a column protection system 2200, wherein protector components 2202 are secured, connected and/or coupled to a column 2204. The column protection system 2200 includes protector component 2202 secured to a column 2204, wherein projections 2220 extend away from the body 2206 of a first protector component 2202 and towards the body 2206 of an adjacent protector component 2202. When installed on a column 2204 having a relatively smaller cross-section, the projections 2220 of a first protector component 2202 are in close proximity to, and may abut, the projections 2220 of a second and adjacent protector component 2202.

In aspects, the projections 2220 of a first side of the first protector component 2202 engage and alternate, or are interleaved, with the projections 2220 of a second side of the second adjacent protector component 2202. Likewise, the projections 2220 of a first side of second protector component 2202 engage and alternate, or are interleaved, with the projections 2220 of a second side of the third adjacent protector component 2202. The projections 2220 of a first side of the third protector component 2202 engage and alternate, or are interleaved, with the projections 2220 of a second side of the fourth adjacent protector component 2202. The projections 2220 of a first side of the fourth protector component 2202 engage and alternate, or are interleaved, with the projections 2220 of a second side of the first adjacent protector component 2202, thereby surrounding the column 2204.

The inner portion of protector component 2202 is shaped to accept a portion of a column 2204. In an embodiment, the inner portion of the protector component 2202 is shaped to accept a corner of a column 2204 having a generally square or rectangular cross-section. In aspects, the inner portion of the protector component 2202 can be shaped to accept a pole or post having a generally circular or oval cross-section. In further embodiments, the inner portion of the protector component 402 can be shaped to accept most any column, support structure or post including, for example, an I-beam or an H-beam.

While embodiments of the disclosed column protector and column protection system have been described, it should be understood that the disclosed column protector and column protection system are not so limited and modifications may be made without departing from the disclosed column protector and column protection system. The scope of the column protector and column protection system are defined by the appended claims, and all devices, processes, and methods that come within the meaning of the claims, either literally or by equivalence, are intended to be embraced therein.

The invention claimed is:

1. An apparatus for protection of an elongated structural support from impact, the apparatus comprising:

an elongated impact protection component (102) in the form of a unitary part having an inner surface (116), an outer surface (118), and a plurality of orthogonally-oriented projections (120) spaced along a length (106) of the elongated impact protection component (102), wherein the projections (120) comprise integrally formed connectors (122, 124), and wherein the projections provide an adjustable and sliding engagement along a length of the projections for interlocking connection to other same type impact protection components (102).

2. The apparatus of claim 1, wherein an inward and outward motion of each interlocked protection component (102) is constrained by the adjacent protection component (102).

3. The apparatus of claim 1, wherein the elongated impact protection component comprises:

a first set of projections (120) extending in a first direction, wherein the projections (120) in the first set of projections (120) include channels (124) having a cross-sectional shape; and a second set of projections (120) extending in a second direction orthogonal to the first direction, wherein the projections (120) in the second set of projections (120) include ribs (122) having a complementary cross-sectional shape to the cross-sectional shape of the channels (124).

4. The apparatus of claim 1, wherein the interlocking connection of the elongated protection component (102) to other same type impact protection components (102) prevents separation of the elongated protection components (102).

5. The apparatus of claim 1, wherein the elongated protection component (102) comprises a hollow, unitary molded component.

6. The apparatus of claim 1, wherein the inner surface (116) of the elongated impact protection component (102) is geometrically similar to a portion of the column (104).

7. The apparatus of claim 1, wherein the elongated impact protection component (102) comprises opposing end portions (108, 110) having indentations for accepting a securing mechanism.

8. The apparatus of claim 1, wherein the projections (120) are sized for a friction fit with projections (120) from other same type impact protection components (102).

* * * * *